United States Patent [19]

Ramachandran

[11] 4,203,851

[45] May 20, 1980

[54] FABRIC SOFTENING COMPOSITIONS AND METHODS FOR MANUFACTURE THEREOF

[75] Inventor: Pallassana N. Ramachandran, Robbinsville, N.J.

[73] Assignee: Colgate-Palmolive Company, New York, N.Y.

[21] Appl. No.: 916,072

[22] Filed: Jun. 16, 1978

[51] Int. Cl.[2] ..... D06M 13/34

[52] U.S. Cl. ..... 252/8.6; 206/0.5; 252/8.8

[58] Field of Search ..... 252/8.6, 8.8; 206/0.5

[56] References Cited

U.S. PATENT DOCUMENTS

| | | | |
|---|---|---|---|
| 3,095,373 | 6/1963 | Blomfield | 252/8.8 |
| 3,861,870 | 1/1975 | Edwards et al. | 252/8.8 |
| 3,896,033 | 7/1975 | Grimm | 252/8.8 |
| 3,904,359 | 9/1975 | Ramachandran | 252/8.6 |
| 3,936,537 | 2/1976 | Baskerville et al. | 252/8.8 |
| 3,989,631 | 7/1976 | Marsan | 252/8.6 |
| 4,035,307 | 7/1977 | Fry et al. | 252/8.6 |

*Primary Examiner*—William E. Schulz

*Attorney, Agent, or Firm*—Richard N. Miller; Murray M. Grill; Herbert S. Sylvester

[57] ABSTRACT

A free flowing particulate fabric softening composition includes base beads, of a water soluble or water insoluble builder for a synthetic organic detergent, impregnated with a fabric softening agent. For example, the base beads may be of a mixture of a zeolite softener (usually a hydrated sodium aluminosilicate), sodium bicarbonate and sodium silicate and the softening agent may be a quaternary ammonium compound, such as distearyl dimethyl ammonium methyl sulfate, with at least 80% and preferably more of the softener being within the original peripheries of the base beads. Also within the invention are softener-detergent compositions which incorporate the described particulate softening composition, a method of using the softening composition in conjunction with a synthetic organic detergent to wash and soften laundry fabrics and a method for the manufacture of the particulate softening compositions.

23 Claims, 3 Drawing Figures

FABRIC SOFTENING COMPOSITIONS AND METHODS FOR MANUFACTURE THEREOF

This invention relates to particulate fabric softening compositions. More particularly, it relates to such compositions wherein beads of a particulate inorganic water soluble and/or water insoluble builder for synthetic organic detergent are impregnated with a fabric softening agent which very significantly penetrates into interior portions of such beads.

Synthetic organic detergents of various types, including anionic, nonionic, amphoteric, ampholytic and cationic types, have been commercially employed for many years for washing dishes and laundry. Often products intended for laundry use have been built by the addition to the synthetic organic detergent of water soluble inorganic and organic builder salts which increase the cleaning power of the detergent. Among such salts pentasodium tripolyphosphate (TPP) has until recently been the most useful but because of evidence indicating that eutrophication of inland waters may be due to the presence of phosphates the employment thereof in detergent compositions has been curtailed, although TPP is still the leading builder. Among substitutes for phosphates that have been introduced are the zeolites, which are water insoluble aluminosilicates capable of removing from wash waters calcium ions which might otherwise interfere with detergency. Although nonionic detergents are becoming more accepted and are often utilized as partial replacements for anionic detergents in commercial detergent compositions intended for home laundry use, anionic detergents are still the major organic detegent components of laundry products and in many cases are superior in cleaning power to and more economical than nonionic detergents. Amphoteric, ampholytic and cationic detergents are at the present employed to only a minor extent in household laundry detergents.

Washing laundry with built synthetic organic detergents often results in the washed materials losing their soft hand and becoming coarse, stiff and irritating to the touch and to the skin. It has been recognized that such condition can be alleviated by treatment of the washed materials with cationic softening agents, which also often have anti-static properties. Such treatment has traditionally been effected by addition of such cationic materials, such as quaternary ammonium salts, to the rinse water, from which they are adsorbed by or chemically combined with fibrous materials of the fabrics being treated. Because of the inconvenience of having to add the softening agent at a particular step of the washing process after initial addition of detergent (and the time spent in waiting) other ways to have the softener applied to the laundry have been sought and have been discovered. In one of these, a substrate containing a softening agent is brought into contact with the laundry in the dryer. In another cationic but unreactive softening agents have been added to the wash water with the detergent composition, were not interfered with by the detergent and did not prevent the detergent from washing satisfactorily, as might otherwise have been expected. Encapsulation of reactive materials has been suggested so that one may be released after the other has performed its function and thereby not interfere with it or be interfered with by it. Detergent-fabric softener compositions have been made which are mixtures of beads of built synthetic organic detergent and beads of fabric softening material, with the fabric softening material sometimes being present in the beads with a material having different functional effects during laundering. Also, fabric softening compositions which are principally fabric softeners on substrates having no detersive function are known for addition to the wash water with a detergent composition at the inception of the washing process. Finally, it is known to coat substrates, such as clays, with fabric softening agents.

Although the prior art includes fabric softening compositions having fabric softening compounds mainly on surfaces of base materials the content of fabric softener is often limited in such products due to the desirability that they be free flowing. Also, because much fabric softener is on the surfaces of the base beads the flow characteristics of the product are like those of the softener, which are not as good as those of the substrate in most cases. Alternatively, if it is desired to coat a substrate of fabric softener with a more free flowing material the product resulting may dust more readily and usually the method of manufacture is more difficult to effect. Thus, there has been a real need for the invention of new compositions and methods which would permit the production of free flowing particulate fabric softening compositions in which the release of the fabric softener would be sufficiently delayed in use so as to avoid premature reaction thereof with any anionic detergent or other reactive materials present which could inactivate the fabric softener or be adversely affected by reaction with it. Such compositions and related processes are subjects of this application.

The closest prior art known to applicant which relates to the manufacture and use of fabric softening compositions and combinations of such compositions with synthetic organic detergents includes U.S. Pat. Nos. 3,095,373; 3,862,058; 3,886,075; 3,936,537; 3,954,632; and 3,993,573. U.S. Pat. No. 3,095,373 describes fabric softeners, such as dialkyl dimethyl ammonium chloride and 2-heptadecyl-1-methyl-1-[2-formamidoethyl]-imidazolinium methyl sulfate, in molten form, mixed with a highly porous synthetic calcium silicate and cooled to form a finely divided, free-flowing powder. When this product was employed to treat cotton muslin swatches in a laboratory Terg-O-Tometer the cationic softening agent was more completely distributed over the fabric than when the calcium silicate was omitted. U.S. Pat. No. 3,862,058 describes particulate built laundry detergent compositions containing certain smectite clays and quaternary ammonium salts. In the preferred embodiments of the invention the described compositions contain anionic synthetic organic detergents and water soluble builder salts. It is mentioned in the patent that the quaternary ammonium anti-static agent (fabric softener) can be sprayed from a melt onto granules of detergent composition made by spray drying a crutcher mix of synthetic organic detergent, clay (smectite) and optional ingredients. U.S. Pat. No. 3,886,075 describes detergent-compatible fabric softening and anti-static compositions containing particular smectite clay materials, cationic anti-static agents and certain substituted amino compound compatibilizing agents, which help to compatibilize the anti-static agents and anionic detergents. The spraying from a melt of anti-static agent and compatibilizing agent onto granules of spray dried detergent composition containing detergent, builder and optional ingredients is taught.

U.S. Pat. No. 3,936,537 describes detergent-compatible anti-static compositions containing a combination of anti-static agent and dispersion inhibitor, preferably with a smectite clay. The patent describes the importance of preventing interaction between a fabric softener and synthetic organic detergent composition with which it may be employed or in which it may be incorporated. U.S. Pat. Nos. 3,954,632 and 3,993,573 disclose detergent-compatible fabric softening and anti-static compositions containing smectite clay, cationic anti-static agent and acidic compatibilizing agent. A manufacturing method taught in the patents includes spray drying a crutcher mixture of clay, detergent, builder and optional ingredients and spraying onto the surfces of the particles thereof a melt of anti-static agent and acidic compatibilizing agent. As in U.S. Pat. No. 3,862,058 the compatibilizing agent helps to prevent adverse reactions between the cationic anti-static or softening agent and anionic materials that may be present, such as anionic synthetic organic detergent.

By means of the method of the present invention there are made particulate softening compositions which are free flowing, which can hold high percentages of softening agent and which are useful as additives to wash water or as components of a detergent-softener composition which includes detergent particles and separate but intermixed, the described free flowing softener-containing beads. Also, the particulate softener compositions may be utilized in rinse water (preferably warm or hot), if desired and in some instances are applicable for inclusion in articles intended for use in the softening of laundry in a laundry dyrer. The method of manufacture of the product of this invention is readily carried out and the softener beads made sufficiently slowly release softener to the wash water so that objectionable interaction of the softener and anionic materials, such as anionic synthetic organic detergents, is diminished, allowing the detergent to wash effectively and the softener to soften laundry effectively without depositing objectionable reaction products thereon.

In accordance with the present invention a free flowing particulate fabric softening composition comprises substantially inorganic water soluble and/or water insoluble base beads of a builder for a synthetic organic detergent impregnated with about 15 to 150% of the base beads weight of a fabric softening agent. By "impregnated" it is meant that a substantial proportion, usually over 70%, preferably over 80%, more preferably over 90% and most preferably, over 95% of the softener is deposited within the exteriors or periphery of the base beads, which are of a porous, often highly reticulate structure. Also within the invention are improved such products containing: a waxy material which protects the softener against premature reaction with anionic materials and which slows the rate of release of softener from the softening composition particles; an ethoxylated monoglyceride or similar compound which diminishes any irritating effect which might be caused by particular softeners being employed; and/or an organic acidic complexing agent which inhibits the development of an amine odor from the cationic softening agent upon aging of the product. Also within the invention is a method of manufacturing the particulate softening composition wherein heated base beads of desired pore structure, usually of inorganic water soluble or water insoluble builder in bead form resulting from spray drying of an aqueous crutcher mix thereof, are contacted with molten fabric softening agent, preferably in the absence of any polar solvent, so that the fabric softening agent penetrates the bead interior. In other aspects of the invention additional materials, such as waxy compounds and compositions, may be blended with the fabric softening agent before penetration of the bead or may be absorbed by the particulate softener beads after previous absorption of a softening agent. Also within the invention are detergent-softener beads and methods of washing utilizing either such beads or separately but approximately simultaneously added fabric softening and detergent compositions.

The present invention will be readily understood by reference to the following description, taken in conjunction with the drawing in which.

Figure 1:
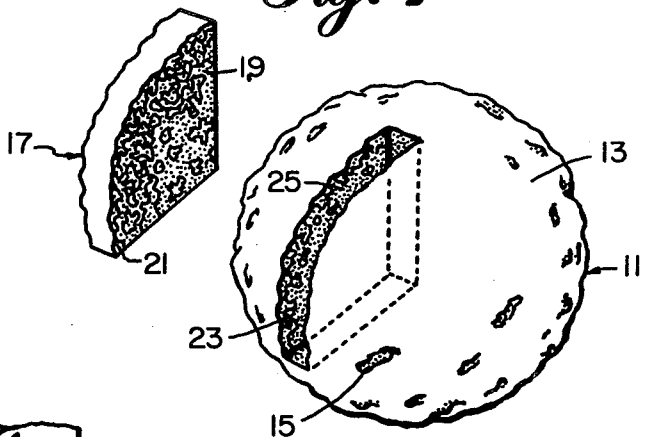
FIG. 1 is a magnified view of a bead of the product of this invention after impregnation of a base bead protion thereof by fabric softener, with a portion thereof removed to exhibit a network of pores therein filled with softener.

The inorganic water soluble and/or water insoluble base beads of a builder for a synthetic organic detergent are important starting materials for the making of the products of this invention. As examples of such water soluble builders there may be mentioned sodium tripolyphosphate, sodium bicarbonate, sodium carbonate, sodium silicate, particularly sodium silicate of $Na_2O$:$SiO_2$ ratio in the range of 1:1.6 to 1:2.8, preferably 1:2.0 to 1:2.4, e.g., 1:2.35, and mixtures thereof. However, other inorganic builders may also be utilized, including borax, tetrasodium pyrophosphate, trisodium phosphate, monosodium dihydrogen phosphate, disodium monohydrogen phosphate and other such compounds which, preferably spray dried, either alone or in mixture with other such materials, will yield the highly porous base beads capable of satisfactorily absorbing liquid (usually molten) fabric softening compound or mixture thereof. The water insoluble detergent builders employed may be any of the various suitable zeolite materials, such as type 4A zeolite, either amorphous or crystalline, hydrated or substantially anhydrous, which are capable of suitably quickly and effectively removing calcium ion (and sometimes magnesium ion) from wash water, thereby exerting a building effect by removing an interferant from the washing medium. Although the type A zeolites, particularly type 4A zeolites, are highly preferable, other zeolites having the desired calcium removing property are also useful, such as zeolite types X and Y, and mixtures of zeolites, e.g., of A and X types. In some instances it may be desired to utilize smectite clays in substitution for all or a part of the zeolite, providing that such clays have a useful calcium removing capability at least 50 mg. eq. of calcium carbonate (all mg. eq. data are on that basis) per 100 grams. Normally, such calcium ion exchange capacity for the smectite clays and any substitutes therefor will be at least 100 mg. eg./100 g. and most preferably over 200 mg. eq./100 g. The preferred zeolites employed usually have much higher exchange capacities for calcium than the ion exchanging clays such normally being in the range of about 200 to 400 or more mg. eq. of calcium carbonate hardness per gram of the aluminosilicate (anhydrous basis) preferably 250 to 350 mg. eq./g.

From the figures given for calcium removing powers it is evident that although various clays can remove calcium ion from aqueous media the zeolites are far superior to other such materials and therefore are highly preferred as components of the present products, in which clays, if present, may be considered as acting essentially as fillers and sometimes as flow promoters.

Although other ion exchanging zeolites may also be utilized normally the finely divided synthetic zeolite builder particles employed in the practice of this invention will be of the formula $$(Na_2O)_x \cdot (Al_2O_3)_y \cdot (SiO_2)_z \cdot wH_2O$$

wherein x is 1, y is from 0.8 to 1.2, preferably about 1, z is from 1.5 to 3.5, preferably 2 to 3 or about 2 and w is from 0 to 9, preferably 2.5 to 6.

The water soluble crystalline aluminosilicates used are often characterized by having a network of substantially uniformly sized pores in the range of about 3 to 10 Angstroms, often being about 4 Å (normal), such size being uniquely determined by the unit structure of the zeolite crystal. Of course, zeolites containing two or more such networks of different pore sizes can also be satisfactorily employed, as can mixtures of such crystalline materials with each other and with amorphous materials, etc.

The zeolite used should be a univalent cation-exchanging zeolite, i.e., it should be an aluminosilicate of a univalent cation such as sodium, potassium, lithium (when practicable) or other alkali metal, ammonium or hydeogen. Preferably the univalent cation of the zeolite is an alkali metal cation, especially sodium or potassium, most preferably being sodium, but various other types are also useful.

Crystalline types of zeolites utilizable as good ion exchangers in the invention, at least in part, include zeolites of the following crystal structure groups: A, X, Y, L, mordenite and erionite, of which types A, X and Y are preferred. Mixtures of such molecular sieve zeolites can also be useful, especially when type A zeolite is present. These crystalline types of zeolite are well known in the art and are more particularly described in the text *Zeolite Molecular Sieves* by Donald W. Breck, published in 1974 by John Wiley & Sons. Typical commercially available zeolites of the aforementioned structural types are listed in Table 9.6 at pages 747–749 of the Breck text, which text is incorporated herein by reference.

Preferably the zeolite used in the invention is synthetic and it is also preferable that it be of type A or similar structure, particularly described at page 133 of the aforementioned text. Good results have been obtained when a Type 4A molecular sieve zeolite is employed, wherein the univalent cation of the zeolite is sodium and the pore size of the zeolite is about 4 Angstroms. Such zeolite molecular sieves are described in U.S. Pat. No. 2,882,243, which refers to them as Zeolite A.

Molecular sieve zeolites can be prepared in either a dehydrated or calcined form which contains from about 0 or about 1.5% to about 3% of moisture or in a hydrated or water loaded form which contains additional bound water in an amount from about 4% up to about 36% of the zeolite total weight, depending on the type of zeolite used. The water-containing hydrated form of the molecular sieve zeolite (preferably about 15 to 70% hydrated) is preferred in the practice of this invention when such crystalline product is used. The manufacture of such crystals is well known in the art. For example, in the preparation of Zeolite A, referred to above, the hydrated zeolite crystals that are formed in the crystallization medium (such as a hydrous amorphous sodium aluminosilicate gel) are used without the high temperature dehydration (calcining to 3% or less water content) that is normally practiced in preparing such crystals for use as catalysts, e.g., cracking catalysts. The crystalline zeolite, in either completely hydrated or partially hydrated form, can be recovered by filtering off the crystals from the crystallization medium and drying them in air at ambient temperature so that their water contents are in the range of about 5 to 30% moisture, preferably about 10 to 25%, such as 17 to 22%. However, the moisture content of the molecular sieve zeolite being employed may be much lower, as was previously described. The zeolites used in this invention should usually be substantially free of adsorbed gases, such as carbon dioxide, since such gas-containing zeolites can produce undesirable foaming when the zeolite-containing detergent is contacted with water.

Preferably the zeolite should be in a finely divided state with the ultimate particle diameters being up to 20 microns, e.g., 0.05 or 0.01 to 20 microns, preferably being from 0.01 to 15 microns and especially preferably of 0.01 to 8 microns mean particle size, e.g., 3 to 7 or 12 microns, if crystalline, and 0.01 to 0.1 micron, e.g., 0.01 to 0.05 micron, if amorphous. Although the ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not sufficiently and satisfactorily exert their water softening properties and may be poorly blendable with other materials to be spray dried.

Although the crystalline synthetic zeolites are more common and better known, amorphous zeolites may be employed instead and can be superior to the crystalline materials in various important properties. Also useful are crystalline-amorphous materials and mixtures of the various types of zeolites described. The particle sizes and pore sizes of such materials may be like those previously described but variations from the indicated ranges may be made, as described, providing that the materials function satisfactorily as builders and do not objectionably overwhiten dyed materials with which they are treated in aqueous media.

Various suitable zeolites are described in U.S. patent applications Ser. Nos. 359,293, filed May 11, 1973; 450,266, filed Mar. 5, 1974; 467,688, filed May 7, 1974; 503,734, filed Sept. 6, 1974; 640,793 and 640,794, filed Dec. 15, 1975; and 747,002, filed Dec. 2, 1976, all of which are hereby incorporated by reference for descriptions of such zeolites and for descriptions therein of other materials of this invention. Useful molecular sieve zeolites are also described in German Offenlegungsschriften 2,412,837 and 2,412,839, Dutch patent specifications Nos. 7403381; 7403382; 7403383 and 7403384 and Belgian Pat. Nos. 814,874 and 835,351, all of which are also hereby incorporated by reference. Additionally, the manufacturings of amorphous and mixed amorphous-crystalline aluminosilicate ion exchange zeolites are described in a U.S. patent application filed July 12, 1974, entitled Detergent Builder Composition (Burton H. Gedge, III and Bryan L. Madison, inventors), also incorporated herein by reference.

The zeolites or other inorganic water insoluble particulate materials capable of removing calcium from aqueous media may be employed as the principal base component but preferably zeolite is employed together with other builder materials, such as the water soluble builder salts of types previously mentioned. Of course, mixtures of zeolites may be utilized, as may be mixtures of other water insoluble calcium ion-removing particulates and/or mixtures of water soluble builders. In some instances small proportions of organic materials, such as organic sequestrants, may also be helpful but normally such will be avoided because it has been found that their presence in the base beads may inhibit penetration of the beads by molten fabric softener. In addition to base compositions including zeolite and water soluble inorganic builder salts, such as in several of the preferred compositions of this invention, to be described in the working examples, other non-phosphate and phosphate-containing base beads may be manufactured from mixtures of carbonate and bicarbonate, e.g., sodium carbonate and sodium bicarbonate, sometimes and often preferably in Wegscheider's salt. Some base beads of types suitable for sorption of molten softener in accordance with the present invention are described in U.S. Pat. No. 3,944,500 and in U.S. patent applications Ser. Nos. 747,002, filed Dec. 2, 1976 and 832,446 and 832,447, filed Sept. 12, 1977, all of which are included herein by reference.

Minor proportions of the base beads may be of fillers, such as sodium sulphate and sodium chloride, instead of builder salts and in some instances filler clays may also be employed despite the fact that they do not possess building properties. However, the proportions of such materials will usually be limited and normally will not be in excess of 50% of the builder present, often being less than 10% thereof. Other adjuvants may be present in the base beads but usually they will be limited to materials which are not gelatinous and do not inhibit transport of fluid through the bead pores. Thus, while preservatives, pigments, fluorescent brighteners, dyes and other non-interfering adjuvants may be present, normally the total proportion thereof will be less than 10% of the beads, by weight (all proportions in this specification are by weight unless otherwise indicated) and preferably individual proportions will not exceed 2%. The base beads may contain from 0 to about 15% of moisture although preferably the moisture content will be less than 10% and more preferably less than 5%. Ideally, providing that the beads are not too friable, the moisture content may be less than 2% and may desirably approach 0%. However, spray drying does not usually result in complete dehydration of a crutcher mix and water of hydration may remain in zeolite and other components of the beads. Of course, it will usually be desirable to minimize water content so as to provide for greater absorption of molten softener.

The softening compounds of this invention include all such organic materials which exert a softening activity in wash water. Normally such materials are cationic and of the cationic compounds the quaternary nitrogen-containing compounds, such as quaternary ammonium salts, are preferred. The softening agent, which is also usually an anti-static agent, will preferably be one which is normally (at room temperature) solid, and substantive to textile materials but normally semi-solid and liquid products can also be used, especially in conjunction with materials of higher melting points. The softening agent will also desirably be of a water solubility to permit complete solution in normal wash water at the use concentration of the softening composition, which will generally be in the range of 0.01 to 0.2%, in either hot or cold water. The softening agents may be of waxy or crystalline characteristics and appearance and may be utilized together with other softeners and with non-softeners, such as waxy materials, in which latter case, especially, the softeners may be liquid, pasty, gelatinous or of normally objectionable sticky characteristics, which will be mitigated due to the presence of the waxy material. Although amphoteric softening agents may be employed, such as dialkyl glycines, which include higher fatty acyl dimethyl glycine and higher fatty acyl amidopropyl dimethyl glycine wherein the higher fatty acyl is of 10 to 14 carbon atoms, e.g., the coconut oil fatty acids, the tallow fatty acids and the hydrogenated tallow fatty acids compounds, normally it will be highly preferred to utilize cationic softeners. These include quaternary ammonium salts which will usually contain a plurality of lower alkyl groups and one or two higher alkyls, benzyls or equivalent groups on the quaternary nitrogen and wherein the salt-forming ion will preferably be chloride or methyl sulfate (or methosulfate), although bromide and ethyl sulfate may also be used, as may be any other suitable anion. The useful quaternary ammonium salts will usually be of the formula $[R^1R^2R^3R^4N]^+ X^-$, wherein $R^1$ is an organic radical which includes an aliphatic radical, an alkyl phenol or an alkyl benzyl of 8 to 22 carbon atoms in the alkyl chain, $R^2$ and $R^3$ each represent hydrocarbyl groups containing from 1 to 4 carbon atoms or $C_{2-4}$ hydroxyalkyl groups and cyclic structures in which the hydrogen atom is in the ring, $R^4$ is an organic radical of a type like like of $R^1$, $R^2$ or $R^3$ and X is an anion, preferably chloride, bromide or methyl sulfate. Although not indicated in the above formula, $R^1$ and/or $R^4$ may be attached to the quaternary nitrogen atom through an ether, alkoxy, ester or amide linkage. Other quaternary ammonium compound softeners which are useful in practicing the invention are imidazolinium compounds wherein substituted on the ring and on the amide carbon are higher alkyl(s) of 8 to 22 carbon atoms. Preferably, in the quaternary ammonium salt formula given the aliphatic substituents are alkyls or monoalkenes of 12 to 22, more preferably 16 to 22 carbon atoms and the alkyls of the alkyl phenol or alkyl benzyl are of 8 to 18, preferably 10 to 16 carbon atoms in the alkyl chain. Most preferably the lower alkyls of $R^2$ and $R^3$ are methyl and Y is methyl sulfate (although chloride and bromide are often equally good). In the imidazolinium compounds the alkyl is preferably of 16 to 20 carbon atoms.

Within the more general description of cationic softening agents given above preferred softeners may be selected from the group consisting of dimethyl higher alkyl benzyl ammonium chlorides, trimethyl higher alkyl ammonium chlorides, trimethyl higher alkyl ammonium methyl sulfates, dimethyl di-higher alkyl ammonium chlorides, dimethyl di-higher alkyl ammonium methyl sulfates, monomethyl tri-higher alkyl ammonium chlorides, methyl dialkoxy higher alkyl ammonium chlorides, methyl dialkoxy higher alkyl ammonium methyl sulfates, methyl dialkoxy higher alkyl ammonium ethyl sulfates, pentamethyl higher alkyl propane diammonium dichlorides and higher alkyl imidazolinium methyl sulfates, wherein higher alkyl is of 8 to 22 carbon atoms and alkoxy is of a unit of 2 to 3 carbon atoms, with 1 to 50 thereof being present per alkoxy. For example, in the above compounds the alkyl may be stearyl or cetyl, the alkoxy may be ethoxy and the number of ethoxies may be about 20.

Preferred specific cationic softening agents utilized in the present invention include di-hydrogenated tallow dimethyl ammonium methyl sulfate; di-hydrogenated tallow dimethyl ammonium chloride; and 1-methyl-1-alkylamidoethyl-2-alkylimidazolinium methyl sulfate wherein the "alkyls" are oleyl or saturated hydrocarbyls derived from tallow or hydrogenated tallow. Dimethyl alkyl benzyl quaternaries that are useful include those wherein the alkyl group is of a mixture of alkyls of 10 to 18 carbon atoms or 12 to 16 carbon atoms, e.g., lauryl, myristyl and palmityl. The various mentioned materials are available commercially from various manufacturers, those from Ashland Chemical Company being identified by tradenames such as Adogen (415; 432; 434; 436; 441; 442; 444; 461; 462; 464; 471; 477; and R-6); Arosurf (TA-100); Variquat (638; 50MC; 60LC; 80MC; A200; B200; C75; E228; K75; K300; LC80); and Varisoft (110; 137; 204-90; 208-90; 222; 222-90; 238; 238-90; 299; 472; 475; 3690; 6112; SDC; and SDC-W).

Although the quaternary softener of this invention may be impregnated into the base beads without the use of auxiliary materials in or with the softener it is often more desirable to use a water insoluble or slightly or slowly soluble waxy one, which may be emulsifiable in an aqueous detergent solution and at least is dispersible therein. Preferably such waxy material is of a higher melting point than the cationic softening agent so that it will not fuse too fast or be too readily removed from the softener beads during use. It is preferred that it be of a melting point of at least 50° C., preferably at least 60° C. and in some cases it may be of higher melting points, e.g., 70° C. or more. Desirably it will soften and/or dissolve or be dispersed comparatively slowly during use and its melting point and/or that of a mixture with softener may be chosen accordingly. Any of a variety of chemicals that will help to control the release of the cationic softening agent from the base beads may be employed but those which are presently considered to be most preferable include the higher fatty acid lower alkanolamides (amides of higher fatty acids and lower alkanols), higher fatty alcohols, higher fatty acids, higher fatty acid mono-, di- and triglycerides, polyethoxylated monoethers of higher fatty alcohols and polyethoxylated alcohol esters of higher fatty acids, wherein the higher fatty groups are of 8 to 22 carbon atoms, preferably of 10 to 18 carbon atoms and the polyethoxy groups are of 3 to 50 ethoxies, preferably of 6 to 20 ethoxies. In addition to the nonionic compounds mentioned it has also been found that cationic emulsifiers of the higher fatty amido amine type may be utilized, such as stearic acid amide of hydroxydiamine or a derivative thereof (such product is sold under the name Chemical 39 Base by Sandoz). A preferred waxy material, stearyl monoethanolamide, is available from Mona Industries under the name Monamid S. Palmityl, cetyl and stearyl alcohols are useful, as are coconut oil fatty acids mono- and diglycerides, stearyl laurate, and condensation products of ethylene oxide and higher fatty alcohols, such as are sold by Shell Chemical Company under the neodol trademark, e.g., Neodols 25-3, 25-7 and 45-11. Instead of the waxy release-controlling materials described other compounds having similar properties may be used, including higher melting quaternary softening agents. Generally, the functions of such materials are: (1) to help to improve the surface characteristics of the softening composition beads so as to aid in making a freely flowing product, such as beads which flow at a rate at least 30% as fast as dry sand, preferably at least 50% as fast and more preferably, at least 70% as fast (thus, the volume of the beads flowing from a reservoir through a tube or restriction will be at least 30% of that of dry sand similarly flowing in a given time); (2) to stabilize the softening agent in the bead, helping to prevent contact with materials with which it might otherwise react to generate malodorous products; (3) to maintain the uniformity of the product by keeping the softening agent in the bead structure despite possible inadvertent raising of the temperature of the product above the normal melting point of the softening compound; and (4) often most important, to control the release of the softening compound from the softening beads to the aqueous medium during use of the product in conjunction with a synthetic organic detergent. Such objectives can be achieved by blending the waxy material with the cationic softener and impregnating the base beads with the mixture or the waxy material may be impregnated into the detergent beads after prior and more centrally located impregnation thereof with softening agent. When employing waxy materials which also have detersive properties, such as some nonionic detergents, the release-slowing action usually desired from the additive will often not be obtained and in such cases the additive may be employed for its other desirable properties, usually with the softening agent being sufficiently slowly released due to its inherent properties and its location in the interior of the softening composition bead.

When the cationic softening agent utilized is one which may be objectionably irritating if brought into contact with sensitive surfaces or portions of the human body, such as the eyes, it has been found desirable to mix with the cationic softener or incorporate exteriorly thereof (although preferably also within the softener bead) an agent which acts to counter such irritation and which also tends to limit contact of the softening compound with such human body portion or organ. Various nonionic detergents of types previously described and to be described in this specification may be employed for this purpose but a preferred group of such compounds includes the ethoxylated monoglycerides, ethoxylated diglycerides and mixtures thereof wherein the higher fatty acid(s) of the glyceride(s) is/are of 8 to 22 carbon atoms, preferably 8 to 16 carbon atoms, a terminal hydroxyl group of each of the glycerides is ethoxylated and the number of ethoxy groups in each is in the range of 10 to 100, preferably 25 to 80, e.g., about 50. Such compounds, sold under the name Varonic® LI surfactants, for example Varonic LI 63 and Varonic LI 67, previously found useful in shampoos to diminish eye irritation sometimes caused by anionic detergent components thereof and sometimes also by alkanolamide foam stabilizers, such as Varamide® MA-1, a coconut oil derived alkanolamide, in the present products help to couneract any eye irritation which might otherwise be the result of the use of the quaternary ammonium softeners, particularly the methyl sulfates such as dihydrogenated tallow dimethyl ammonium methyl sulfate. Thus, the ethoxylated mono- and diglycerides, in addition to use as physical barriers to release of the softening agents from the softening composition beads, also help to counteract any eye irritating effects thereof, which has been firmly established by standard rabbit eye testing. Similar desirable effects may be obtainable from other nonionic surface active agents, which also may contribute their detersive effects to the compositions.

Fabric softening materials are desirably perfumed to make them acceptable to the purchaser, pleasant to use and sometimes, to slightly perfume materials treated with the softening agent. It has been found that on storage in the presence of other softening composition components, including the perfume, the cationic softeners (and sometimes amphoteric softeners, too) deteriorate and produce objectionable amine-type odors. Various sequestrants may be used to help to tie up metal ions which could catalyze such decomposition but it has been found that very satisfactory products of good aroma result when sequestering or chelating organic acids are employed, such as the hydroxy lower carboxylic acids, di- or polyhydroxy lower carboxylic acids, di- or polyhydroxy lower di- or polycarboxylic acids and hydroxy lower di- and/or polycarboxylic acids, which compounds are usually of 2 to 8 carbon atoms, preferably 3 to 6 carbon atoms, with 1 to 6 hydroxyls and 1 to 4 carboxylic acid groups thereon, and also are preferably saturated. Among such materials may be mentioned citric acid, tartaric acid, gluconic acid, glucuronic acid, lactic acid, succinic acid, malic acid, fumaric acid, adipic acid, ascorbic acid and saccharic acid. The small quantities of such sequestrants, in addition to helping to diminish any decomposition which may be accelerated due to the presence of sequestrable materials in the fabric softening compositions, will neutralize any amine which may be produced by such decomposition, thereby preventing the development of an objectionable odor therefrom. Furthermore, the normally solid acids, in particulate form, do not diminish product flowability. In addition to the preferred acidic sequestrants, other sequestrants, either inorganic or organic, may also be employed, such as nitrilotriacetic acid or salts thereof, ethylene diamine tetraacetic acid or salts thereof, e.g., the sodium salts, and zeolites and polyphosphates, when employed, may also have such desirable effects, as may other compatible normally solid organic and inorganic acids.

Figure 2:
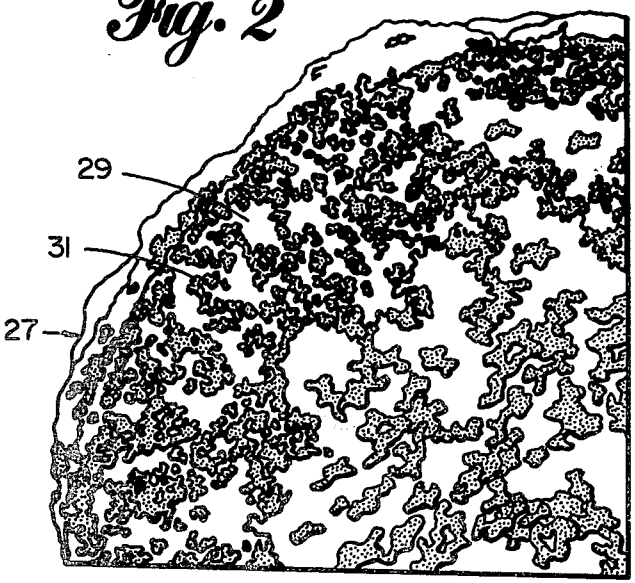
FIG. 2 is an enlarged view of the section of FIG. 1 before impregnation of the base bead with fabric softener.

The manufacture of the present softening compositions is comparatively simple but it is important that the base beads employed be of desired porous, reticulate (not merely hollow) bead structure, such as is illustrated in FIG. 2. The base beads employed are those obtained by spray drying although it is possible to utilize beads of similar structure made by other processes. The base beads will normally contain from 30 to 80%, frequently 40 to 70% of free volume, which may be filled by penetrating fluid material. The beads will be essentially inorganic because it has been found that the presence of organic material in large quantities, e.g., over 20%, changes the character of the beads and makes them less reticulate, often resulting in the usual hollow globular typical spray dried bead, which is not as satisfactory for making the present softener products. The particle sizes of the beads will normally be within the No. 8 to No. 200 U.S. Sieve Series range, preferably being from No. 40 to No. 170 or 200. Preferred base beads, which may be based primarily on any of the inorganic builders previously mentioned or mixtures thereof, may be made as described in any of U.S. patent applications Ser. Nos. 661,471, filed Feb. 26, 1976; 727,838, filed Sept. 29, 1976; 747,001 and 747,002, both filed Dec. 2, 1976; 832,446 and 832,447, both filed Sept. 12, 1977, incorporated herein by reference.

The satisfactory porous base beads employed, at an elevated temperature, are contacted with the softening agent which is in the liquid state, having been heated to promote liquefaction. Although a small proportion of solvent, e.g., up to 10%, may sometimes be present with the softening agent it is usually more desirable that it be completely anhydrous or as water-free as practicable, so as to allow for the inclusion in the product of the greatest quantity of softening agent and also so as to minimize hydrolytic decomposition of any product components. Similarly, although some moisture may be present in the base beads, usually being from 2 to 15% thereof, preferably no more than 10% thereof, the proportion of moisture present will desirably be minimized to the extent that the product is still satisfactorily strong, form-retaining and not objectionably prone to powdering.

The temperature of the base beads should be high enough so that the sprayed on or otherwise applied molten softening agent is not cooled to non-flowing form before reaching the bead interior. In addition to allowing penetration of the bead by the heated sotening agent, heating of the bead also facilitates opening up of passageways in it due to expansion of internal gas and expulsion of such gas from the bead as the liquid softening agent penetrates the bead. The penetration of the bead by the liquid is aided by capillary and surface active effects and because application of the liquid to the beads will normally be uneven, at least initially, due to small droplet sizes of the sprays and moving of the beads during application, room will be left for air or other gas passage out of the bead as the liquid enters it.

The temperature to which the beads may be heated may vary depending on the nature of the softening agent but will usually be in the range of 40° to 100° C., preferably 50° to 80° C. and most preferably 50° to 70° C. Higher temperatures may be employed and higher melting softening agents may be utilized when washing temperatures are expected to be more elevated than the usual 50° to 70° C. or lower temperature, presently common in actual American household laundry practice. Similarly, the melting point of a 100% active fabric softening material may be adjusted accordingly but preferably it will be in the range of 40° to 80° C., most preferably 50° to 70° C. Such melting points may be lowered, if desired, by the presence of solvent or other compounding agent and may be raised by utilization of an anti-release agent, such as those previously described as useful in the practice of this invention.

The temperature of the softening agent used will be high enough to maintain it liquid when it is applied to the heated base beads. This will normally be in the 40° to 100° C. range, most preferably 50° to 70° or 80° C. Also, the spray temperature should be high enough so that, in conjunction with the temperature of the particles of base beads onto which the softener is being sprayed or with which it is otherwise brought into contact, it will maintain its liquid nature until it penetrates to the central interiors of the beads. The temperature employed for the softener and the melting point of the softener will similarly be like those for the release-controlling agent and any other material which it is desired to have penetrate into the beads' interiors. However, often such materials will have melting points and application temperatures as much as 20° or 30° C. higher than those of the softeners but if the softener and release-controller are applied together they will be at the same temperature, within the liquid range of the mixture.

The softening agent, mixture of softening agent and release controlling agent, release controlling agent and anti-irritation additive are preferably applied to the base beads or previously partially impregnated base beads as sprays, having spherical droplet sizes ranging from about 0.1 to 2 mm. in diameter, preferably 0.2 to 1 mm. Such sprayed droplets will satisfactorily impregnate the base beads with which they come into contact. Even the larger droplets will satisfactorily be spread over the surfaces and into the interiors of the beads due to moving bed action of the beads, it being highly preferred that the application of the softener and any other desirably penetrating materials be made onto a moving bed of base beads, such as a bed of such beads in a twin shell blender, a Lodige mixer, an inclined drum or tube, inclined about 5° to 20° from the horizontal, a Day mixer or other such blender. Instead of utilizing sprays, the liquid material may be dripped onto the moving bed of beads and in some applications it has been found possible merely to add the liquid to the beads and then agitate to provide for ready contact of the liquid with all the beads and impregnation thereof. Providing that the temperature is maintained high enough to keep the material being applied in liquid form it penetrates satisfactorily to the bead interiors. Of course, when the softener or other such impregnant is sprayed onto the bead surfaces the air or other gas, e.g., nitrogen, through which it is sprayed should be warm enough so as not to cause premature solidification of the softening agent or the softening agent should be heated adequately to compensate for any cooling effects of the gas medium through which the droplets pass. Normally the spraying of the softener onto the heated beads will take place over a comparatively short period of time, e.g., 30 seconds to 10 minutes, preferably one minute to three minutes and the beads will be further mixed for up to another ten minutes, e.g., 30 seconds to five minutes or one minute to three minutes.

When, instead of applying the softener alone or mixed with release controlling agent, the waxy controlling agent is subsequently applied it can form, at least partially, a protective internal coating about the softening agent. To maximize the extent of such coating it may be desirable preliminarily to cool the impregnated beads before subsequent application of the waxy material. This may have the desirable effect of locating the softening agent in a central interior portion of the bead. Then, by subsequent heating of the beads, preferably without heating long enough to melt a substantial proportion of the softening agent in the bead interiors or to melt any thereof the waxy material and anti-irritation compound may be impregnated into the beads at portions of the interiors thereof nearer to the peripheries and such impregnations may be simultaneous or sequential. Alternatively, such materials may be applied in mixture with the softening agent or may be sequentially applied without intermediate coolings of the beads. In all such cases at least 80% of the impregnating materials, especially at least 80% of the softening agent, will normally be within the interior or within the peripheral bounds of the bead so that the flow characteristics of the base beads will not be changed adversely to a significant extent due to the presence of the impregnant(s). Desirably the total proportion of softener and other of the mentioned impregnating materials within the bead periphery will be 90%, preferably 95% and ideally, 100% thereof.

After impregnation of the base beads is completed perfume and complexing acid may be applied thereto, preferably with the acid, as a powder, being mixed with or dusted onto the particles, followed by spraying on of the perfume, although the order may be changed and the perfume may be applied as a stream or liquid "sheet" to moving particles. If the complexing or sequestering acid is applied first it will tend to prevent to some extent contact of the perfume with the softening agent and will also help to neutralize any amine odor which may be developed from the softener on storage. To further improve flow characteristics of the product and to add some additional softening capability to it, of a different type from that generated by the cationic softener, a flow improving quantity of a particulate calcined aluminum silicate having fabric softening properties, such as Satintone II, may be dusted onto the beads or otherwise blended with them at this stage, usually after perfume addition.

As was previously mentioned the base beads utilized may be of various types but it is preferred to employ those which are spray dried blends of inorganic builder materials, either water insoluble or water soluble. Although base beads made from a single builder may be employed normally mixtures of builders will be used and such mixtures or single builders will normally comprise significant proportions, normally major and at least 70%, preferably at least 80% or more of the base beads, with proportions of organic adjuvant materials, detergents, etc., being held to 10% or less in many cases. In some preferred compositions, wherein a mixture of zeolite, sodium bicarbonate and sodium silicate is present, the proportions thereof may be of about 20 to 70% of zeolite, 10 to 50% of sodium bicarbonate and 10 to 25% of sodium silicate, preferably with these ranges being 30 to 60%, 20 to 40% and 10 to 20%, respectively. Examples of other useful base bead compositions include spray dried mixtures of 60 to 90% of pentasodium tripolyphosphate and 10 to 25% of sodium silicate; 25 to 75% of alkali metal carbonate and 25 to 75% of alkali metal bicarbonate, preferably wherein the alkali metal is sodium; and 25 to 75% of zeolite and 25 to 75% of pentasodium tripolyphosphate, preferably 40 to 60% of each.

The proportion of fabric softening agent in the base beads on a base bead weight basis, will be within the range of about 15 to 150%, preferably being 25 to 150% and more preferably 40 to 120%, e.g., 40 to 70%. When a release-controlling agent such as a previously described waxy material, is present the total quantity of such material and fabric softening agent may be in the 15 to 150% range, with the ranges of such component materials each usually being in the 15 to 100% range, based on the weight of the base beads and preferably being within the 20 or 25 to 75% range, with the proportion of softener to waxy material being within the range 1:4 to 4:1, preferably 1:2 to 2:1 and usually more preferably, 2:3 to 3:2. The particle sizes of the products made after absorption of the fabric softener (and also after absorption of the release-controlling agent, when employed) will usually be within the ranges previously described for the base beads because, although there may be some dimensional change, it usually is not significant. However, in some cases the larger beads, the sizes of which were given previously, may be increased in size to No. 6 and No. 30, making the bead size ranges from 6 to 200, preferably 30 to 170, U.S. Sieve Series. The bulky density of the products made will obviously be greater than that for normal spray dried materials, especially the base beads, and will usually be in the range of 0.3 to 1 g./ml., preferably 0.5 to 0.8 g./ml. The flowability of the described products will preferably be measured compared to clean dry sand of similar particle sizes. To obtain a good free flowing product it is desirable that base beads utilized should contain at least 50%, preferably 70% and more preferably 80 or 90% of builder, which is usually an inorganic water soluble and/or water insoluble detergent builder or a mixture of one or both types of such builders. So as to maintain the good flowability of the products, over 80% of the softening agent and/or flow controlling material to be absorbed by the base beads is absorbed in such manner as to be within the peripheries thereof, and such figure is preferably 90 or 95% and ideally is 100%. By choosing the types of softener(s) and release controlling agent(s) accordingly it is possible to make free flowing products even when an appreciable proportion of the softener and/or release-controlling agent is outside the peripheries of the base beads (in such cases more than 20% may be outside such peripheries) but in doing so one loses some of the advantages of having the base bead also acting as a means for regulating control of dissolving or dispersing of the softener. Some softeners are sufficiently high melting and therefore are free flowing, so that they may be employed as a powder together with the products of this invention. For example, Arosurf TA-100 may be post-added to the product as a powder, as may be various other normally powdered cationic softeners.

With respect to the perfume stabilization aspect of this invention the quantity of perfuming material present will usually be in the range of 0.1 to 3% of a total weight of the softening beads of this invention, preferably being 0.2 to 2% thereof and more preferably 0.3 to 1%. The acidic complexing agent utilized to stabilize the perfume or at least to prevent the development of a harsh amine odor from the softening compound on storage will usually be from 0.2 to 5%, preferably 0.3 to 3% and more preferably 0.5 to 2%, e.g., 1%, on a final softening product basis. On a base bead basis the weight of complexing agent, such as citric acid, will usually be within the range of 0.5 to 10%, preferably about 0.5 to 5% and more preferably about 1 to 4%.

The proportion of powdered calcined aluminun silicate having fabric softening properties, e.g., Satintone II, will usually be from ½ to 20%, on a final product basis, of the softener beads, preferably from 2 to 12% thereof and more preferably from 5 to 10%. The aluminum silicate utilized is one wherein the crystals are thin, flat and of laminated plate structure and the average particle size is in the range of 1 to 3 microns. Such a flow improving and softening agent contains about 52.1% of silicon (as $SiO_2$) and 44.4% of aluminum (as $Al_2O_3$) and loses about 0.9% of its weight upon ignition.

Figure 3:
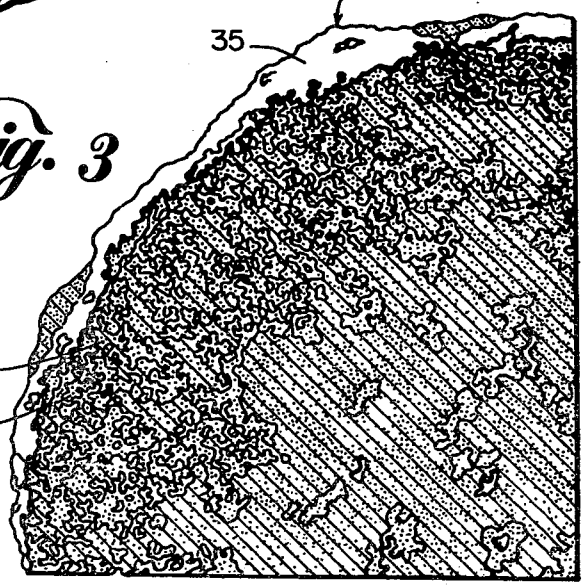
FIG. 3 is a view of a section of bead like that of FIG. 2 after impregnation thereof by fabric softener.

The absorption by a base bead of the fabric softening compound and other materials, such as waxy release-controlling agent, and the making of a free flowing product of this invention is illustrated in FIGS. 1–3. In FIG. 1 the finished softener bead 11 is shown, thinly coated with softening material 13 and with some sections 15 of the bead having softening compound absorbed therein but not being surface coated with it. Removed quarter section 17 illustrates the internal reticulate structure of the bead with various filled passageways 19 therein and internal walls 21 bounding such passageways. Similarly, such structure is illustrated in the wall 23 on the internal side of the bead which had adjoined the removed section 17. Filled cavaties 25 are shown therein. In FIG. 2 a part of the base bead is illustrated in more enlarged cross-section before application of the softener and/or release agent, etc. In the uncoated and untreated base bead 27 (shown in a cross-section like that of FIG. 1) passageways 29 are bounded by wall members 31. Similarly, in FIG. 3 such passageways, now filled with softening material (and/or release controlling material) 33, improve bead flow due to the fact that the surface 35 of softener bead 37 does not contain a large quantity of tacky material to inhibit flow.

Although the softener beads described are useful in themselves as agents for softening laundry their most important presently contemplated use is in conjunction with synthetic organic detergents in compositions and processes for washing and softening laundry. The softener bead, with or without detergent beads present, can be employed to make fabric softening solutions, pastes or manufactured articles containing the beads and such products can be used to impart softness to laundry by washing machine or dryer application. Nevertheless, in most applications for these products they will be employed in conjunction with synthetic organic detergents and they are particularly advantageous when utilized with such detergent compositions which contain anionic materials, usually anionic synthetic organic detergents, which materials are usually incompatible with softening compounds, especially cationic softeners. In addition to diminishing the softening effect of the cationic compound by chemical reaction of the anionic compound with it the desired detergent action due to the presence of the anionic compound is also diminished and furthermore, the product that is formed by reaction of the softener and the detergent or other anionic material may in itself be quite objectionable, sometimes forming a fatty or curdy material which can adhere to the laundry in unsightly deposits. By use of the present invention, wherein softener release to the wash water is slowed due to the penetration into the interior of the reticulate base bead structure of the softening material, the diminution of detergency is lessened, compared to use of a product containing the same components but without having the softening agent penetrating the base bead. Thus by the present invention good softening and detergency are obtained and objectionable fatty or curdy deposits of cationic-anionic reaction products are avoided.

The fabric softening compositions of this invention may be pre-blended with detergent compositions, such as heavy duty synthetic organic detergent compositions or they may be added to the washing machine at about the same time as or after the detergent composition is added. Usually the proportion of synthetic organic detergent composition beads to fabric softening composition beads, by weight, will be in the range of 20:1 to 3:2, preferably 10:1 to 2:1 and more preferably 5:1 to 3:1, with the proportion of synthetic anionic detergent to cationic softening compound usually being in the range of 10:1 to 1:1, preferably 5:1 to 2:1.

The detergent composition with which the present softener beads may be incorporated or with which it may be employed may be anionic and/or nonionic in nature and in some cases amphoteric products may also be used. However, to obtain the advantageous cleaning power desired and to obtain the important advantage of the present invention wherein the impregnated base beads do not adversely react with anionic materials, normally an anionic detergent will be a significant component of the detergent composition. Thus, although it may be highly desirable to employ a mixture of anionic and nonionic synthetic organic detergents, usually the anionic detergent will be the more significant cleaning component.

Among the anionic detergents that are useful are the sulfates and sulfonates of lipophilic moieties, especially those containing higher carbon atom chains, such as those of 8 to 20 or 10 to 18 carbon atoms. Included among such compounds are the linear higher alkyl benzene sulfonates, olefin sulfonates, paraffin sulfonates, fatty acid soaps, higher fatty alcohol sulfates, higher fatty acid monoglyceride sulfates, sulfated condensation products of ethylene oxide (3 to 30 mols per mol) and higher fatty alcohol, higher fatty acid esters of isethionic acid and other known anionic detergents, such as are mentioned in McCutcheon's *Detergents and Emulsifiers,* 1973 Annual and *Surface Active Agents,* Vol. II, by Schwartz, Perry and Berch (Interscience Publishers, 1958), the descriptions of which are incorporated herein by reference. Exemplary of such materials are sodium tridecyl benezene sulfonate, sodium $C_{12-14}$ olefin sulfate, sodium $C_{16-18}$ paraffin sulfonate, sodium coco-tallow soap wherein the charge of coconut oil and hydrogenated tallow employed to make the soap is in a 1:4 proportion, sodium lauryl alcohol sulfate, sodium coconut oil fatty acids monoglyceride suflfate, the sodium salt of the sulfuric acid condensation product of seven mols of ethylene oxide with a mol of $C_{12-15}$ higher fatty alcohol and the sodium salt of the myristic acid ester of isethionic acid.

With the anionic detergent there may be employed a nonionic detergent which is a condensation product of ethylene oxide and higher fatty acid, higher fatty alcohol or other lipophilic moiety, such as polypropylene oxide. Such nonionic detergents are usually pasty or waxy solids at room temperature (20° C.) which are either sufficiently water soluble to dissolve promptly in water or will quickly melt at the temperature of the wash water, as when that temperature is above 40° C. Nonionic detergents employed in the detergent composition beads will normally be those which are pasty or semisolid at room temperature because such are less likely than liquids to make a tacky product of poor flow properties and susceptibility toward lumping or setting on storage. Typical useful nonionic detergents are the poly-(lower alkenoxy) derivatives that are usually prepared by the condensation of lower (2 to 4 carbon atoms) alkylene oxide, e.g., ethylene oxide, propylene oxide (with enough ethylene oxide to make a water soluble product), with a compound having a hydrophobic hydrocarbon chain and containing one or more active hydrogen atoms, such as higher alkyl phenols, higher fatty acids, higher fatty mercaptans, higher fatty amines and higher fatty polyols and alcohols, e.g., fatty alcohols having 8 to 20 or 10 to 18 carbon atoms in an alkyl chain and alkoxylated with an average of about 3 to 30, preferably 3 to 15 or 6 to 12 lower alkylene oxide units. Preferred nonionic surfactants are those represented by the formula $RO(C_2H_4O)_nH$, wherein R is the residue of a linear saturated primary alcohol (an alkyl) of 10 or 12 to 18 carbon atoms and n is an integer from 3 or 6 to 15. Typical commercial nonionic surface active agents suitable for use in the invention include Neodol ® 45-11, which is an ethoxylation product (having an average of about 11 ethylene oxide units) of a 14 to 15 carbon atoms (average) chain fatty alcohol (made by Shell Chemical Company); Neodol 25-7, a 12 to 15 carbon atom chain fatty alcohol ethoxylated with an average of 7 ethylene oxide units; and Alfonic ®1618-65, which is a 16 to 18 carbon alkanol ethoxylated with an average of 10 to 11 ethylene oxide units (Continental Oil Company). Also useful are the Igepals ® of GAF Co., Inc. Such materials are usually the polyethoxylated (3 to 30 ethylene oxide units) middle alkyl (6 to 10 carbon atoms) phenols, such as Igepals CA-630, CA-730 and CO-630. The Pluronics ® (made by BASF-Wyandotte), such as Pluronic F-68 and F-127, which are condensates of ethylene oxide with hydrophobic bases formed by condensing propylene oxide with propylene glycol, usually having molecular weights in the range of 5,000 to 25,000, may also be employed, as may be the various Tweens ® (products of ICI America), which are polyoxyethylene sorbitan higher fatty acid (12 to 18 carbon atoms) esters, such as those containing solubilizing quantities of ethylene oxide therein. Various other nonionic detergents described in the texts previously incorporated by reference may also be employed but preferably the proportion of nonionic detergent or surface active agent present, when such is other than the higher fatty alcohol polyoxyethylene ethanols, will be a minor one, rarely being more than 50% and more preferably no more than 25% of the total nonionic detergent content. In the above description, higher, as in higher alkyl, higher fatty, etc., means from 8 to 20 carbon atoms in a chain, preferably from 10 or 12 to 18.

When a mixture of anionic and nonionic synthetic organic detergent is used the proportion of anionic detergent will generally be greater than that of the nonionic detergent, normally being from 8 to 35% of the detergent composition beads whereas the proportion of nonionic detergent will generally be from 1 to 15% thereof. Preferred ranges are 10 to 25% and 2 to 8%, respectively.

In addition to the synthetic organic detergents, builder compounds and/or filler materials will normally be present, with the synthetic organic detergent composition beads generally including from 4 to 60% of synthetic organic detergent and 40 to 96% of inorganic water soluble and/or water insoluble builder for the synthetic organic detergent. The builder material present may be any suitable builder salt, usually being a water soluble inorganic builder salt, but insoluble builder materials, such as the zeolites, previously mentioned, may also be utilized. Preferred builders are polyphosphates, such as pentasodium tripolyphosphate and tetrasodium pyrophosphate, carbonates, such as sodium carbonate, bicarbonates, such as sodium bicarbonate, borax and silicates, such as sodium silicate of $Na_2O$:-$SiO_2$ ratio in the range of 1:1.6 to 1:2.8 or 1:3.0. In substitution for part of the builder component there may be utilized filler salts, such as sodium chloride or sodium sulfate, which may replace 0 to 5% of the builder, e.g., 10 to 40% thereof.

Various adjuvants, both functional and asthetic, may be included in the present compositions, such as bleaches, e.g., sodium perborate, colorants, e.g., pigments, dyes; fluorescent brighteners, e.g., stilbene brighteners; foam stabilizers, e.g., alkanolamides, such as lauric myristic diethanolamide; enzymes, e.g., proteases; skin protecting and conditioning agents, such as water soluble proteins of low molecular weight, obtained by hydrolysis of proteinaceous materials, such as animal hair, hides, gelatin, collagen; foam destroyers, e.g., silicones; bactericides, e.g., hexachlorophene; and perfumes. Such and other adjuvants may also be present in the softener beads, when feasible and desirable.

The detergent composition beads will preferably be of hollow globular form, made by conventional spray drying, but other techniques are also practicable. They may contain a small proportion of moisture, normally being from 2 to 12%, which is also usually the range of total content of the adjuvant materials. The products will usually be made by spray drying an aqueous crutcher mix in the manner known in the art and then post-adding to it in a tumbling drum or other blender various adjuvants which may be unstable during the spray drying operation and hence, unsuited to it or which are designed to improve flow properties. The particle sizes of the detergent composition beads will approximate those of the softener beads but sometimes may be somewhat larger, e.g., from 6 to 140 mesh, preferably from 8 to 100 mesh.

Usually, when a blended product is being made containing both build synthetic organic detergent composition beads and fabric softening composition beads any ordinary dry blending method may be employed and sometimes a mixture of the two compositions is treated with suitable adjuvants, such as perfumes and foam improving agents, either by dry blending with or spraying onto the product particles, after pre-mixing of the detergent and softener compositions but such is not necessary and it is often more economical and efficient to merely dry blend together the previously essentially complete detergent and softener composition powders.

In the washing and softening of frabrics, such as those of laundry, ordinary and common methods of automatic machine washing may be employed. Thus, the amount of detergent utilized will be that which is normally used, usually from 0.05 to 0.3%, preferably 0.1 to 0.2%, e.g., 0.15% of detergent composition, with a lesser proportion (usually) of cationic softening compound being present than of the anionic detergent of the detergent composition. For example, in utilizing a mixture of four parts by weight of a conventional or commercial heavy duty detergent powder and one part by weight of softener composition beads, wherein the detergent powder contains about 25% of sodium linear tridecyl benzene sulfonate and the softener beads contain about 40% of di-hydrogenated tallow dimethyl ammonium methyl sulfate, 0.19% of the mixture may be employed so that 0.15% of the detergent composition would be present in the wash water. This amount or proportion of the mentioned mixed product is added to a standard tubful of wash water, normally of a hardness of 50 to 250 parts per million, as calcium carbonate, at a temperature in the range of 20° to 80° C., preferably 50° to 70° C., but most often from 40° to 50° C. and an ordinary wash cycle is commenced, wherein laundry is washed over a period of from 5 to 45 minutes and is then rinsed, usually twice, with warm or cold water and spun or pressed "dry". In a similar manner, when the softener composition beads are not pre-blended with the detergent composition beads separate quantities of the product (to produce the same "solution" in the wash water) may be employed, which are usually added simultaneously or almost simultaneously to the wash water before washing. If desired, to further delay release of the softening compound to the wash water, where it could react objectionably with anionic detergent present, it may be added after the addition of detergent powder, in such case preferably five to ten minutes thereafter, and the washing may be continued for 5 to 30 minutes after addition of the fabric softening composition, preferably 5 to 15 minutes thereafter. However, for convenience, the present softener is often added with the detergent so that the homemaker does not have to wait before adding the softener.

The advantages of the present invention, compared with prior art compositions and methods, have been referred to previously but will now be recited in greater detail. Because of the pre-heating of the base beads onto which the molten (or dissolved) fabric softener is sprayed or to which it is otherwise applied as a liquid the softener material penetrates more deeply into the beads, impregnating them, rather than merely coating them. This leads to an improvement in flow properties of the beads, because even when some of the surfaces thereof are covered with softener, uncovered portions or protrusions aid flow so that the products will often flow at least 50% as fast through a restriction or when being poured from a container as will dry sand of essentially the same particle sizes. Additionally, the presence of the softening agent below the surface of the base beads or to a significant extent below such surface slows the release of softener so that when it is employed in conjunction with anionic materials, such as a synthetic organic detergent of the anionic type, less softener will be consumed in reaction with the anionic detergent than would be the case were it not to have been sub-surface present in the base beads of the softening composition. The result is that better softening and detergency are obtained by use of the present softening composition in conjunction with anionic detergents, either when incorporated in detergent-softener compositions or utilized together by separate additions to the wash water of such detergent compositions and softener compositions. Also, the importance of utilizing a specially suitable base material for the softener compositions should not be overlooked. The base beads of inorganic material suitable for use as builders for synthetic organic detergents, especially those of the anionic type, are firm and free-flowing and more importantly, when the type described, which may be made by the method detailed in U.S. Pat. application Ser. No. 661,471, previously mentioned, or in the other patent applications mentioned herein therewith, all of which have been included in this application by reference, softeners are relatively inactivated with respect to chemical reactions with anionic detergents. The reticulate nature of the base beads so described provides a more tortuous path for the softener to follow to be released to the wash water and consequently, such release is slowed. Similarly, the use of the mentioned builder salts of the inorganic type provides a good slow-release base, especially if the builder employed is water insoluble, such as the zeolites. The absence of surface active agent or organic detersive material from the beads and the absence of any break-up agent or solvent in them also helps to prevent premature dispersal or solution of the beads and their components. (Note that the pre-heated beads may contain enough energy to vaporize off any solvent, e.g., alcohol, which might be used to help to dissolve the softener prior to application). Of course, when a waxy material is additionally present such will act as a binder and will tend to hold the individual beads together, thereby slowing release of softener to the wash water. When the particulate softener composition is pre-mixed with a powdered detergent composition the physical separation of the softener from the detergent because of penetration into the base bead interior helps to prevent premature reaction, even in the presence of substantial proportions of moisture in stored products. Such premature reaction is also inhibited by the presence of a waxy release-controlling agent in the softener. The described advantages of the present product, in addition to being theoretically justifiable, have been experimentally verified. Release rates have been determined by titration and actual washing and softening tests of laundry treated by the present products, compared to controls wherein the softeners employed were not impregnated into base beads as described herein, were run. It has been established that an important distinction over the prior art has been obtained and that a significant improvement in the desirable properties of the invented softening compositions has resulted.

The following examples illustrate but do not limit the invention. Unless otherwise indicated all parts therein and in the specification and in the appendant claims are by weight and all temperatures are in °C.

EXAMPLE 1

50 Grams of Varisoft 137[1] and 50 grams of Fresh Start base beads (phosphate formula)[2] are heated on a steam bath and are stirred until the temperatures of both the beads and the Varisoft 137 reach 50° C., at which temperature the Varisoft 137 has been transformed to the liquid state and is absorbed into the warmed base beads. The product is removed from the steam bath and cooled to room temperature (25° C.). The product resulting, reticulate base beads with softener absorbed therein, is free flowing, of normal detergent bead size (in the No. 40 to No. 170 U.S. Sieve size range) free flowing, flowing about 75% as fast from a carton or through a restriction as does dry sand of essentially the same particle size distribution, stable on storage and of excellent softening characteristics when employed in conjunction with a heavy duty synthetic detergent composition based principally on anionic detergent (sodium linear tridecylbenzene sulfonate) and builder salt (pentasodium tripolyphosphate), used in washing and softening laundry in 100 p.p.m. hardness (as calcium carbonate) city water, at a temperature in the range of 50° to 70° C., utilizing a conventional wash cycle, washing for 15 minutes, rinsing with two rinses and spinning to damp condition, after which the laundry is dried in an automatic dryer for about 45 minutes at a temperature of about 80° C.

(1) Di-hydrogenated tallow dimethyl ammonium methyl sulfate (90% active paste in 10% of isopropanol)

(2) 75% Sodium tripolyphosphate, 12% sodium silicate ($Na_2O:SiO_2=1:2.4$), about 3% (total) of coloring agents, fluorescent brighteners, sodium carboxymethyl cellulose, and about 10% of moisture.

The beads made are examined and are found to be of a structure like that shown in FIGS. 1 and 3, with the Varisoft 137 softening agent penetrating through the network of passageways in the base beads so that only a small portion, less than 5%, of the softening agent is not within the peripheries of the base beads. The product made has a bulk density of about 0.7 g./ml., about twice that of the base beads, and the particles are of essentially the same sizes as those of the base beads.

In a variation of the process of this Example, instead of heating together the base beads and the softener on a steam bath the beads are heated on such a bath and after being heated to about 60° C., the Varisoft 137, at about 50° C., is sprayed onto the surfaces thereof from a typical spraying apparatus, as essentially spherical droplets having diameters in the 0.2 to 1 mm. range, while the base beads are maintained in motion by hand mixing. The product resulting is essentially the same as that previously described, with the same characteristics, and the process is more efficient and economical when employed on a larger scale, substituting for hand mixing the use of a commercial mixing apparatus, such as a Day mixer, Twin Shell blender or Lodige mixer. Although batch processes have been described the application of the softener by spraying is especially adaptable to continuous production of the softening composition particles of this invention by utilization of a flow-through mixer design, such as inclined drum or cylinder, inclined at an angle of about 8° from the horizontal, with base beads being continuously added at the upper end and withdrawn from the lower end thereof. Alternatively, the molten (or, less preferably, dissolved) softening agent may be dripped onto moving base beads as drops, streams or "sheets" of liquid to produce a desired softening composition but spraying as described is preferred.

In a variation of the formula of this Example, the phosphate type of Fresh Start base bead is replaced by a zeolite type[3] thereof and the proportions of Varisoft 137 and base bead are changed to 40 parts of the softener and 60 parts of base bead. The manufacturing methods are as previously described and the product resulting is of similar characteristics, although because there is a smaller proportion of softening agent present therein it is less effective as a fabric softener despite the fact that the zeolite contributes some compensatory softening action.

(3) 66% Type 4A zeolite, anhydrous (crystalline, as charged and about 22% hydrated), of ultimate particle sizes of about 3 to 7 microns and of gross particle sizes in the No. 140 to 325 U.S. Sieve Series range, 17% sodium carbonate, 3% minor ingredients (color, brightener, CMC) and 14% of moisture A further variation in the formula of the product is made by substituting a Fresh Start base bead of the carbonate/bicarbonate type[4] for the zeolite type bead previously mentioned. The product obtained is essentially the same in the various characteristics mentioned as that based on the zeolite type bead.

(4) 13% Sodium carbonate, 58% sodium bicarbonate, 22% sodium silicate ($Na_2O:SiO_2=1:2.4$), 2% minor ingredients (as previously described) and 5% of moisture.

The products described above and other similar products mentioned in this specification wherein other softening agents of the group described previously in this specification replace Varisoft 137, either in whole or in part, and other acceptable reticulate base particles replace the described Fresh Start base beads, either in whole or in part, have more than 80% and more preferably more than 90% of the softening agent within the peripheries of the base beads and as a result thereof, when employed with an anionic-based synthetic organic detergent composition, preferably a built and heavy duty detergent, because of the slower release of softening agent, do not result in as severe a reaction of the softening agent (usually of the cationic type) with the anionic detergent or other anionic materials present. Thus, compared to controls wherein the various components are added to the wash water together, but not in the desired form of this invention, the softening results due to use of the experimental product are superior and it has also been noted that detergency is improved and objectionable curdy, gelatinous or oily deposits of reaction product are not present.

EXAMPLE 2

In the formulas of Example 1 there are substituted for the base beads described other Fresh Start base beads of the following formulas:

(1) 45% zeolite, anhydrous (as described in Example 1), 30% sodium bicarbonate, 15% sodium silicate ($Na_2O:SiO_2=1:2.4$), 3% minor ingredients (as described in Example 1) and 7% of moisture; and (2) 68% sodium carbonate, 23% sodium silicate ($Na_2O:SiO_2=1:2.4$), 2% minor ingredients (as described supra), and 7% moisture.

The products possess softening, flow, dimensional, stability and release characteristics as described in Example 1, above.

EXAMPLE 3

Utilizing the zeolite type base bead of Example 1 with Varisoft 137 applied internally thereto, as in Example 1 a comparison is made with "control"products wherein the softening agent is omitted, added to the wash water alone and together with (but not absorbed in) the zeolite type base. Softening effects and fluorescent intensities of the treated fabric items are measured and are compared. The detergent employed is an anionic detergent containing about 22% of sodium linear tridecylbenzene sulfonate, 30% of pentasodium tripolyphosphate, 8% of sodium silicate ($Na_20:SiO_2=1:2.4$), 30% of sodium sulfate, 3% of adjuvants (1.5% of Tinopal 5BM fluorescent brighter, perfume, colorant, CMC) and 7% of moisture. The concentration of such built detergent composition is 0.15% in the wash water and that of the fabric softening agent is about 0.015%, corresponding to about 0.048% of the softening composition. The wash water is at a temperature of 50 °C. and contains 150 p.p.m. of mixed calcium and magnesium hardness (as calcium carbonate). The detergent and experimental materials are mixed together prior to addition to the wash water and they are added to it before beginning the wash, which lasts 45 minutes and including two rinses and spin drying, after which the test towel material (which are of cotton) are dried in an automatic laundry dryer. It is found that on a softness scale of 1 to 10, with 10 representing greatest softness, when the zeolite base beads impregnated with softening agent are employed the softness rating of the towels is 10, whereas when the same amounts of zeolite beads and softener are separately mixed with detergent before the washing-softening treatment the softness reading is 4. Utilizing only the same amount of softener and adding it with the detergent a reading of 5 is obtained and when so softening agent or zeolite is present the reading is 1. With respect to detergency, the experimental products all diminish detergency somewhat, with a significantly lesser diminution (−10) being obtained with the use of the base beads impregnated with softening agent. A reading of −18 is obtained when the softening agent alone is mixed with the detergent (no base beads being employed) and a reading of −20 results when both softening agent and base beads (not pregnated with softener) are utilized. Fluorescent intensity of the washed and softened swatches or towels is measured and it is found that it is about the same in all cases, compared to a control.

In other comparative testing, (A) a mixture of anionic detergent and softener-impregnated base beads, (B) a mixture of nonionic detergent composition (20% Neodol 23-6.5, 10% sodium silicate, 60% sodium tripolyphosphate, 3% adjuvants [including 1.5% of Tinopal 5BM fluorescent brightener] and 7% of moisture) plus impregnated base beads and (C) a commercial softener-containing detergent composition (Bold 3) are compared, for soil removal, softness, fluorescent brightness, yellowness and whiteness of treated towels, using the same wasing-softening conditions previously described in this Example. It is found that anionic detergent plus softener-impregnated base beads is clearly superior to the commercial softener-detergent in cleaning power and is about equal to it in softening and brightening effects. It is significantly superior to the nonionic detergent with softener-impregnated base beads in brightening power and is about equal to it in cleaning and softening.

EXAMPLE 4

20 Grams of Neodol 45-11, a nonionic detergent which is the condensation product of the mixed higher fatty alcohol of 14 to 15 carbon atoms with about 11 mols of ethylene oxide, and 20 grams of Varisoft 137 are melted together by heating the mixture to a temperature of 50° C. and then the mixture is used in place of 40 grams of Varisoft 137, as described in Example 1 and is applied to 60 grams of the three pre-heated Fresh Start base beads, as in Example 1. The presence of the nonionic detergent, which is somewhat waxy in nature, although comparatively water soluble, improves the flowability of the products so as to make it better than for produts wherein the softening agent is merely sprayed onto the surface of unheated base beads so as to coat them. However, due to the excellent surface activity of the nonionic detergent the particulate softener compositions made, when added to wash water, disperse more readily and therefore the advantages of slow dispersion, improved softening and detersive activities and lack of any reaction product in the wash water and on the laundry, are not obtained to the extent desired nor resulting from use of the products of Example 1. Additionally, the lesser proportion of softening agent present in the beads requires more of the composition to be employed to obtain the same softening activity. Similar results to those of this Example are obtained when equal parts of the nonionic detergent and Varisoft 137 are employed in the other formulas of Examples 1 and 2 in place of the softening agent therein and when the proportions of nonionic detergent (nonionic surface active agents may be substituted, too) and fabric softening compound are changed over the 2:3 to 3:2 and 2:1 and 1:2 ranges.

EXAMPLE 5

A further improved free flowing softening composition for use with heavy duty detergent compositions containing built anionic synthetic organic detergent, in which the fabric softening agent is more slowly released in the wash water (hot or cold), is made by melting together 20 grams of Monamid-S[5] and 20 grams of Varisoft 137 and absorbing the melted mix into heated base beads of the zeolite type, as described in Example 2 (taken in conjunction with Example 1). The product is of very good softening properties but is less effective as a softening agent than the product of Example 2 because it contains only half as much Varisoft 137 as such product. The softening composition resulting is free flowing, like those of the other Examples and additionally, because of the presence of the Monamid-S, which serves to delay dispersion and solution of the softening agent, may be used in wash water together with synthetic anionic detergent compositions without objectionably adversely reacting with them to diminish softening and cleaning. Thus, when 12 parts by weight of the zeolite type Fresh Start base beads mentioned in Example 2 are impregnated with 8 parts by weight of a mixture of equal parts of Varisoft 137 and Monamid-S and the softener composition beads made are mixed with 80 parts by weight of anionic detergent of the type previously mentioned in Example 3 an excellent free flowing detergent-softener product is obtained wherein the softening effects are rated 10 (or better) and the soil removal index (SRI), compared to 0 for the anionic detergent alone (80 parts), is −4. Such soil removal index is superior to that for 80 parts of the same anionic detergent plus 12 parts of zeolite base beads with 8 parts of Varisoft 137 incorporated therein, for which the SRI is −8. It is also superior to that for 80 parts of the anionic detergent with 8 parts of Varisoft 137 impregnating 12 parts of the bicarbonate-carbonate base beads of Example 1 (SRI = −8) and is superior in soil removal to a mere mixture of 80 parts of anionic detergent with 12 parts of zeolite base beads and 8 parts of a 50:50 blend (melted together) of Varisoft 137 and Monamid-S (SRI = −17). Thus, this experiment shows that even with the use of a lesser proportion of softening agent good softening is obtainable and with the waxy amide (Monamid-S) present better soil removal is obtainable when the softening agent and waxy material are impregnated together into the base beads.

(5) Stearyl monoethanolamide (Mona Industries)

EXAMPLE 6

This Example repeats that of Example 5 with respect to utilizing the same weights of Varisoft 137, Monamid-S powder and zeolite-type recticulate structure base beads but with the difference that the Varisoft 137 is first absorbed into the base beads, after which the Monamid-S powder is mixed with the heated beads to produce a free flowing powder. In such case, the Monamid-S is also absorbed into the beads with over 80% of the total weight of softening agent and waxy material being within the peripheries of the beads and with the Monamid-S being located in the beads about the initially absorbed Varisoft 137. The product obtained is an excellent fabric softener when employed together with anionic detergent of the composition previously mentioned and when used with such detergent has even less of a soil removal index diminution effect (−3) than does the composition of Example 5. The same or better results are obtainable when the beads that have been impregnated with liquid softener (molten or dissolved to some extent in solvent, e.g., 95% ethanol, in equal parts) are cooled and have any solvent present removed so that the softener is solidified in the base beads, after which the beads are reheated about such softener while it remains solid and the waxy material is absorbed by them about the softener. Thus, the beads containing softening agent may be cooled to 10° C. and then reheated so that the peripheral portions are at 50° C. while the interiors are at about 25°-30° C., at which time the waxy impregnant is applied, in a liquid bath, spray or similar form.

When, in this Example and in Example 5, the Monamid-S is replaced by other waxy materials such as are described earlier in this specification and the Varisoft 137 is similarly replaced by other suitable softening agents, as so described, essentially the same effects are obtained, excellent softening with little diminution in detergency characteristics.

EXAMPLE 7

The experiments of Examples 1, 2 and 4 are repeated, with pilot plant batches being made, utilizing the zeolite type Fresh Start base beads and Varisoft 137, with the sizes of the batches being about 1,000 times as great as those of the described Examples. The processes utilized, wherein spraying of the Varisoft 137 into the heated base beads is practiced, with the spray droplet sizes being essentially the same as described in Example 1 and with other conditions being similarly controlled, result in impregnated products which, when employed with anionic detergent, as previously described are of excellent softening characteristics and of better soil removing powers than a corresponding product wherein the same materials are present but separate. Such characteristics and effects obtain when the particulate softener compositons are employed together with various other built anionic detergent compositions, based on the other anionic detergents mentioned earlier in this specification and built with the other builders mentioned, in about the same proportions, and also result when unbuilt anionic detergent compositions are employed with the softener compositions of this invention. Furthermore, the proportions of softening compositions and detergents may be changed within the ranges previously given and similar effects are obtained. Also, when the impregnated reticulate base beads of this invention are compared to merely coated base beads, with the proportions of softener and base beads being the same or substantially the same the products of this invention are superior in detergent-softener uses, especially with respect to detergency but also with respect to softening, because delayed dispersion and solution of the softening agent or agents used diminishes wasteful and often harmful reactions between the detergent and the softener or at the very least allows the detergent to exert its cleaning effect in the early part of the wash cycle without being interfered with by the softener.

EXAMPLE 8

The softener composition beads of Example 2, including 40 parts of Varisoft 137 fabric softener in 60 parts of zeolite type base beads, are added in 0.015% concentration to wash water of 150 p.p.m. hardness (as $CaCO_3$) and at 50° C. and after various times, from ½ to 10 minutes, samples of the wash water are taken and are titrated to determine the proportion of softener that has been released from the beads and is dissolved and/or dispersed in the wash water. Such testing results in the finding that after about 30 seconds about 7% of the softener has been released, after about 2 minutes about 25% has been released, after about 4 minutes about 35% has been released, after about 5 minutes about 45% has been released, after about 7 minutes about 55% has been released and after about 10 minutes about 70% has been released. Thus, it is seen that the incorporation of the softener in the interiors of the base beads (impregnation) results in comparatively slow release thereof in wash water so that reaction with anionic detergent during at least the first minutes of washing is preventable to a significant extent. Similar but slower release characteristics are obtained when a waxy material such as cetyl alcohol, myristyl monoethanolamide or hydrogenated coconut oil fatty acids monoglyceride, is utilized with the softener, either co-melted with it or applied to the base beads after application thereto of the softener, as described in previous Examples. When the softener is merely applied as a surface coating on beads that were not pre-heated and therefore, which cool the melt of softener more rapidly, resulting in greater surface deposition and coating thereof, the release of the softening agent is much more rapid, with more than 50% thereof being released within the first minute after addition to the wash water.

In another experiment designed to show whether slowed release of softening agent in wash water improves detergency, the brightnesses of soiled cloths are measured utilizing (1) 0.15% of anionic detergent composition alone (LAS type previously described in these examples), (2) 0.15% of such anionic detergent plus 0.04% of 12 parts of zeolite type base beads impregnated with 8 parts of Varisoft 137 softening agent and (3) 0.15% of the anionic detergent plus 0.016% of Varisoft 137 and 0.024% of the zeolite type base (unimpregnated). When the anionic detergent alone is employed the Rd readings for washed swatches are about 54.5 whereas with such detergent plus the fabric softener-impregnated base beads such reading drops to about 46.3. When the detergent, softener and base beads (unimpregnated) are added together at the beginning of washing the Rd reading is about 22. However, if addition is delayed one minute this reading increases to about 32 and delays of two minutes and three minutes (after addition of the detergent) result in improved readings of about 38 and 42, respectively. Thus, it is clear that the fabric softener, if present in the wash water in available form early in the washing, does interfere with detergency and therefore the products of the present invention, wherein release of the fabric softener is delayed, promote improved detergency, while also resulting in softening of the washed goods. For such reasons sometimes the softener composition is added to the wash water about 5 to 15 minutes after the beginning of washing but although additionally advantageous, such is not necessary for good washing and softening when the invented products are employed.

EXAMPLE 9

| Component | Parts by Weight |
|---|---|
| Base beads[6] | 50.5 |
| Varisoft 137 | 20.0 |
| Arosurf TA-100[7] | 20.0 |
| Varonic LI 67[8] | 5.0 |
| Satintone II[9] | 3.0 |
| Citric acid | 1.0 |
| Perfume[10] | 0.5 |
| | 100.0 |

[6]Zeolite-based beads of 3) (see Example 1)
[7]Distearyl dimethyl ammonium chloride powder (about 95% active ingredient)
[8]Ethoxylated glyceryl monococoate, 99+% active ingredient, solid (also identified as PEG-78 glyceryl monococoate) [Varonic LI 63 is another ethoxylated glyceryl monococoate, a 99+% active ingredient soft paste, also known as PEG-30 glyceryl monococoate]
[9]Calcined aluminum silicate in thin, flat, laminated plate form having an average particle size of about 2 microns, a maximum residue on a 325 mesh U.S. Sieve of 0.01%, a specific gravity of about 2.5 and a loose bulk density of about 0.3 g./ml.
[10]K-1347, a solution of essential oils, synthetic odorants, resinoids and fixatives, including perfume aldehydes, alcohols and esters.

The base beads are heated to 55° C. and the Varisoft 137, heated to the same temperature, is added to the warm beads and is absorbed into the interiors of such beads while they are being mixed. Alternatively, the Varisoft 137 is sprayed onto the surfaces of a moving bed of such beads. To the warmed beads is applied the Varionic LI 67, which is partially absorbed into the beads and partially coats the beads, with less than 20% of the total of the Varisoft 137 and Varonic LI 67 being outside the peripheries of the reticulate beads. After cooling of the beads to room temperature the Arosurf TA-100 is post-added as a powder, followed by application of the citric acid as a powder, after which the perfume is sprayed on and the Satintone II, as a powder, is mixed in with the beads.

The product obtained, when employed with a heavy duty synthetic organic anionic detergent composition of the LAS type previously described, in 1:10 weight proportions and at usual detergent concentrations in the wash water (0.1 to 0.2%), gives effective softening of laundry of both cotton and polyester-cotton blends and is an effective detergent and laundry brightener. When the Arosurf TA-100 is replaced by Varisoft 137, which is absorbed strongly by the beads, even better detergency and softening are obtained. However, in both cases the product is free flowing, stable on storage, yielding little or no amine odor from decomposition of the softening agent and perhaps most important of all, because of the presence of the Varonic LI 67 with and coating the softener beads, eye irritation, which sometimes accompanies the use of Varisoft 137, is minimized, as is shown by rabbit eye testing wherein the proportion of irritation results is markedly diminished.

In place of Varonic LI 67 Varonic LI 63[8] is employed to obtain similar results. In place of Varisoft 137 Varisoft 137-M is also substituted. It contains smaller amounts of impurities sometimes considered to be irritating (free amines and hydrosulfates). Instead of applying the citric acid as a powder, it may be applied as an aqueous or solvent solution and dried before application of the perfume and Satintone II. In place of Satintone II, Satintone I may be utilized but although it also aids flowability it has essentially no softening effect, unlike Satintone II. Also, in place of citric acid other sequestering acids such as gluconic acid, tartaric acid and ascorbic acid may be wholly or partially substituted but citric acid is preferred. Other sequestering and acidifying agents, such as ethylene diamine tetraacetic acid and nitrilotriacetic may also be employed, as may be acidic and buffering materials capable of reacting with and counteracting any ammonia and amines generated by the decomposition of the softening agent, e.g., boric acid, monosodium phosphate, sodium bisulfate and mixtures, but N-containing compounds are often avoided. In the above formula the base beads are those of the first zeolite type described in the working examples of the specification but when the other four specific types of base beads are substituted for it equivalent results are obtained, all of the products being free flowing particulate softening compositions effective as softeners for use in wash water with detergents, especially anionic detergents, when added with the detergent or shortly thereafter, without having significantly adverse effects on the washing powers of the detergents. Also, they are non-irritating to the eyes.

(8) Ethoxylated glyceryl monococoate, 99+% active ingredient, solid (also identified as PEG-78 glyceryl monococoate) [Varonic LI 63 is another ethoxylated glyceryl monococoate, a 99+% active ingredient soft paste, also known as PEG-30 glyceryl monococoate]

The above formula is varied by utilizing 60.5% of the base beads and 10% of the Arosurf TA-100 in one case and 70.5% of the base bead and no Arosurf TA-100 in another experiment. As is expectable, the softening effects in both such cases are lessened but greater efficiency of softening is obtained, considering the diminished quantities of softening agent employed. All the products are free flowing but those with lesser quantities of Arosurf TA-100 are of lesser interferant effects on anionic detergent with which they are employed. The products are non-irritating, perfume stability is good and no appreciable amine-type malodor develops on storage.

EXAMPLE 10

| | Parts by Weight |
|---|---|
| Base beads (any of the Fresh Start beads previously described or mixtures thereof) | 52.5 |
| Varisoft 137 | 35.0 |
| Varonic LI 63 | 5.0 |
| Satintone II | 6.0 |
| Citric acid (powder) | 1.0 |
| Perfume | 0.5 |
| | 100.0 |

A product of the above formula is made by impregnating the base beads at 55° C. with the Varisoft 137, at 55° C., followed by impregnation of the product with Varonic LI 63 at 55° C., in the manner previously described, after which powdered citric acid is dusted thereon, followed by perfume application and mixing with Satintone II. The product is free flowing, non-irritating, of good aroma and an effective softener and does not interfere objectionably with detergency when utilized together with synthetic anionic organic detergents in heavy duty laundering of cotton and synthetic fabrics. Substitution of Varonic LI 67 for Varonic LI 63 results in a similarly acceptable product of about the same characteristics.

EXAMPLE 11

| | Parts by Weight |
|---|---|
| Base beads (any of the Fresh Start beads previously described or mixtures thereof) | 52.5 |
| Varisoft 3690 (90% active ingredient)[11] | 40.0 |
| Satintone II | 6.0 |
| Citric acid | 1.0 |
| Perfume | 0.5 |
| | 100.0 |

[11]Methyl (1)oleyl amido ethyl (2)oleyl imidazolinium methyl sulfate

EXAMPLE 12

| | Parts by Weight |
|---|---|
| Base beads (either of the Fresh Start zeolite bead formulas or described variations thereof) | 65.0 |
| Varisoft 222-90[12] | 30.0 |
| Satintone I[13] | 3.0 |
| Citric acid | 1.5 |
| Perfume | 0.5 |
| | 100.0 |

[12]A proprietary formulated methyl sulfate quaternary softener in paste form and containing about 90% solids, (mfd. by Ashland Chemical Company)
[13]Calcined aluminum silicate powder of thin, flat and laminated plate structure of slightly higher specific gravity and bulk volume than Satintone II but non-softening The products of Examples 11 and 12, made by the methods previously described, are free flowing softening compositions, useful alone or in conjunction with built synthetic organic detergents of the anionic and/or nonionic types for washing and softening cotton and/or polyester-cotton laundry fabrics. They don't release amine odor on storage.

EXAMPLE 13

| | Parts by Weight |
|---|---|
| Zeolite base bead[3] | 60.0 |
| Varisoft 190-100[14] | 32.0 |
| Propylene glycol | 8.0 |

[3]66% Type 4A zeolite, anhydrous (crystalline, as charged and about 22% hydrated), of ultimate particle sizes of about 3 to 7 microns and of gross particle sizes in the No. 140 to 325 U.S. Sieve Series range, 17% sodium carbonate, 3% minor ingredients (color, brightener, CMC) and 14% of moisture
[14]100% active powder softener based on dimethyl distearyl ammonium methyl sulfate (alkyl distribution of stearyl is about 5% myristyl, 30% palmityl and 65% stearyl, with a maximum content of about 5% of free amine and amine hydrosulfate, as in Varisoft 137)

The 60 parts of the base bead, at a temperature of about 55° C., are mixed with 40 parts of a heated mixture of Varisoft 190-100P and the propylene glycol, which impregnates the beads so that less than 10% of the Varisoft 190-100P is outside the peripheral portions of the original base beads. The product resulting is free flowing, has desirable softening characteristics and when employed together with or in mixture with built heavy duty anionic-based laundry detergents of the types previously described gives effective softening of cotton and synthetic fabrics and laundry, while not interfering objectionably with washing power of the detergent. When the formula is varied, increasing the Varisoft 190-100P concentration to 36.0%, diminishing the propylene glycol to 6.4% and decreasing the base bead proportion to 57.6%, a similarly acceptable product is obtained of slightly greater softening power but which does not objectionably interfere with detergency of heavy duty anionic synthetic organic detergents with which it may be employed. In place of the Varisoft 190-100P in both the foregoing embodiments of this example there may be substituted Arosurf TA-100 or Arquad 2H-T (100%), which is approximately the same chemical constitution as Arosurf TA-100. Also, in place of propylene glycol other solvents such as isopropyl alcohol, hexylene glycol, various Cellosolves®, Carbitols® and other suitable solvents are employable. The products obtained are free flowing beads, effective softeners and substantially non-interfering or not objectionably interfering with anionic detergent action in laundering operations wherein the softener beads and detergent are employed together.

EXAMPLE 14

| | Parts by Weight |
|---|---|
| Zeolite type 4A, anhydrous | 28.57 |
| Sodium silicate ($Na_2O:SiO_2$ = 1:2.4) | 9.09 |
| Sodium bicarbonate | 19.48 |
| Tinopal 5BM fluorescent brightener | 1.69 |
| Varisoft 137-M | 33.57 |
| Citric acid, powder | 1.00 |
| Perfume K-1347 | 0.50 |
| Xylene Red B dye solution | 0.01 |
| Water | 6.09 |
| | 100.00 |

The above fabric softening composition beads, of particle size within the 60 to 170 mesh range, are made in the manner previously described, with the zeolite base beads, containing zeolite, silicate, bicarbonate and Tinopal 5BM, being heated to a temperature of about 55° C. and having sprayed onto the surfaces thereof the Varisoft 137-M at about the same temperature, so that the Varisoft impregnates the base beads, after which they are cooled to room temperature, dusted with citric acid, perfumed and colored in the manner previously described.

The product made is an excellent softening composition, useful with heavy duty built synthetic anionic organic laundry detergent in automatic washing and softening of laundry, including cotton, cotton-polyester and synthetic materials, e.g., nylons, and is stable on storage, with little or no amine or ammoniacal odor being developed, even when being compounded with about twice as much by weight of built synthetic anionic detergent of about the same particle size. The product is also free flowing, flowing about half as fast as dry sand of similar particle size. It is an effective softener and does not objectionably diminish the detersive activity of the detergent composition with which it may be employed. However, due to the presence of the cationic methyl sulfate softener, despite the fact that the content of free amine and amine hydrosulfate therewith is lower than with Varisoft 137 softener, the product is still somewhat irritating, as shown by rabbit eye testing.

EXAMPLE 15

| | Parts by Weight |
|---|---|
| Zeolite type 4A, anhydrous | 27.19 |
| Sodium silicate ($Na_2O:SiO_2$ = 1:2.4) | 8.65 |
| Sodium bicarbonate | 18.54 |
| Tinopal 5BM fluorescent brightener | 1.60 |
| Varisoft 137-M | 31.95 |
| Varonic LI 63 | 4.76 |
| Citric acid, powder | 1.00 |
| Perfume K-1347 | 0.50 |
| Xylene Red B dye solution | 0.01 |
| Water | 5.80 |
| | 100.00 |

This product is made in the same manner as that described in Example 14 with the difference that after impregnation of the base beads with Varisoft 137-M the beads are cooled to room temperature, reheated and heated Varonic LI 63, at 55° C., is sprayed onto the beads and is impregnated therein. Subsequent treatments with citric acid, etc., are the same. The product made has all the desirable properties of that of Example 14 but additionally, rabbit eye testing indicates that irritation levels have been lowered significantly due to the presence of the Varonic LI 63. In similar experiments the Varonic LI 63 is blended with the Varisoft 137-M before impregnation and/or is applied to the bead surfaces after impregnation with the Varisoft 137-M. In both such cases irritation is diminished but better flowabilities are obtained when the Varisoft 137-M and Varonic LI 63 are impregnated into the beads. Also, when Varonic LI 67 is substituted for Varonic LI 63 in these experiments similar results are obtainable.

The invention has been described with respect to various illustrations and embodiments thereof but is not to be limited to these because it is evident that one of skill in the art with the present description before him will be able to utilize substitutes and equivalents without departing from the spirit of the invention or going outside the scope thereof.

What is claimed is:

1. A free-flowing particulate fabric softening composition comprising base beads impregnated with about 15 to 150% of the base beads weight of a normally solid, cationic quaternary ammonium softening agent selected from the group consisting of salts of the formula $[R^1R^2R^3R^4N]^+X^-$ wherein $R^1$ is an organic radical of 8 to 22 carbon atoms, $R^2$ and $R^3$ each represent $C_1$–$C_4$ alkyl or $C_2$–$C_4$ hydroxyalkyl groups, $R^4$ is an organic radical of the type like $R^1$ or $R^2$ or $R^3$ and X is an anion and of imidazolinium compounds wherein a $C_8$–$C_{22}$ alkyl group is substituted on the ring and on the quaternary nitrogen, said base beads having a particle size in the range of 8 mesh to 200 mesh U.S. Sieve Series, having a free volume from 30% to 80% and containing at least 70% by weight of an inorganic water-soluble and/or water-insoluble detergent builder selected from the group consisting of sodium aluminosilicates of calcium ion exchange capacity of at least 200 milligram equivalents per gram, pentasodium tripolyphosphate, sodium carbonate, sodium bicarbonate and sodium silicate having an $Na_2O$ to $SiO_2$ ratio in the range of 1:1.16 to 1:2.8 and mixtures thereof and containing from 0 to 15% by weight of water, with over 80% by weight of said softening agent being present within the interior of said base beads and the particles of said composition being of a size which pass a No. 8 U.S. Sieve and are retained by a No. 200 U.S. Sieve.

2. A composition according to claim 1 wherein the base beads further contain a waxy material which is emulsifiable in aqueous media, is of a higher melting point than the softening agent and is selected from the group consisting of higher fatty acid lower alkanolamides, higher fatty alcohols, higher fatty acids, higher fatty acid mono-, di- and triglycerides, polyethoxylated monoethers of higher fatty alcohols and polyethoxylated alcohol esters of higher fatty acids, wherein the higher fatty groups are of 8 to 22 carbon atoms and the polyethoxy groups are of 3 to 50 ethoxies, the precentages of said waxy material and said cationic softening agent each being in the range of 15 to 100% of the weight of the base beads, with the total weight of said waxy material and the softening agent being from 15 to 150% of the weight of the base beads and with over 80% of said waxy material being within the interiors of the base beads.

3. A composition according to claim 1 impregnated in addition with a sufficient proportion of a material selected from the group consisting of ethoxylated monoglycerides and ethoxylated diglycerides of $C_8$–$C_{22}$ fatty acids wherein a terminal hydroxyl group of each of the glycerides is ethoxylated with 10 to 100 ethoxy groups and mixtures of said monoglycerides and diglycerides, so as to be of diminished irritating effect as determined by rabbit eye testing.

4. A free-flowing particulate fabric softening composition of improved fragrance comprising the composition of claim 1 wherein further includes a perfuming amount of perfume which includes organic alcohols and/or esters which may promote decomposition of said softening agents and a stabilizing proportion of a $C_2$–$C_8$ organic acid complexing agent which inhibits development of an amine odor from the cationic softening agent upon aging of the product.

5. A free-flowing particulate synthetic organic detergent-fabric softening composition comprising synthetic organic detergent composition beads which include from 4 to 60% by weight of synthetic organic detergent and 40 to 96% by weight of a detergent builder selected from the group consisting of water-soluble inorganic salts, water-insoluble inorganic salts and water-soluble organic salts, and fabric softening composition beads of claim 1, the proportions of said detergent beads to said fabric softening composition beads being in the range of 20:1 to 3:2 by weight.

6. A method of washing and softening fabric materials which comprises agitating them in an aqueous medium at a temperature in the range of 20° to 80° C. in a washing machine to which has been added the composition of claim 5.

7. A method according to claim 6 wherein the aqueous medium is in a washing machine and is at a temperature in the range of 50° to 70° C., the synthetic organic detergent is a sulfated or sulfonated anionic detergent or such with a nonionic detergent and is present in synthetic organic detergent composition beads with a larger quantity of builder and the builders in each of the synthetic organic detergent composition and the fabric softening composition are each selected from the group consisting of sodium aluminosilicates of calcium ion exchange capacity of at least 200 mg. equivalents per gram, pentasodium tripolyphosphate, sodium carbonte, sodium bicarbonate and sodium silicate having an $Na_2O$ to $O_2$ ratio in the range of 1:1.6 to 1:2.8 and mixtures thereof, the beads of the detergent being of particle sizes which pass a No. 8 U.S. Sieve and are retained by a No. 200 U.S. Sieve and the washing time being 5 to 15 minutes after addition of the detergent fabric softening composition.

8. A method of making a free-flowing particulate fabric softening composition which comprises the step of impregnating heated base beads having a particle size in the range of 8 mesh to 200 mesh U.S. Sieve Series and a free volume of 30% to 80%, said base beads containing at least 70% by weight of an inorganic water-soluble or water-insoluble detergent builder selected from the group consisting of sodium aluminosilicates having a calcium ion exchange capacity of at least 200 milligram equivalents per gram, pentasodium tripolyphosphate, sodium carbonate, sodium bicarbonate, sodium silicate having an $Na_2O$ to $SiO_2$ ratio of 1:1.6 to 1:2.8 and mixtures thereof, with about 15 to 150% of the base beads weight of a normally solid, cationic quaternary ammonium softening agent selected from the group consisting of salts of formula $[R^1R^2R^3R^4N]^+X^-$ wherein $R^1$ is an organic radical which includes an aliphatic radical of 8 to 22 carbon atoms, $R^2$ and $R^3$ each represent $C_1$–$C_4$ alkyl or $C_2$–$C_4$ hydroxyalkyl groups, $R^4$ is an organic radical of the type like $R^1$ or $R^2$ or $R^3$ and X is an anion and of imidazolinium compounds wherein $C_8$–$C_{22}$ alkyl group is substituted on the ring and on the quaternary nitrogen, said softening agent being in the liquid state and said base beads being at a temperature high enough to maintain said softener in liquid state after contact therewith so that it penetrates into the bead interiors such that at least 80% thereof is below the base bead exterior.

9. A method according to claim 8 wherein said softening agent is sprayed onto a moving bed of the heated base beads.

10. A method according to claim 8 wherein after impregnation of the base beads with fabric softener such beads, containing the fabric softener essentially interiorly thereof, are further impregnated with a different waxy material which slows the release characteristics of the softener, said waxy material being selected from the group consisting of higher fatty acid lower alkanolamides, higher fatty alcohols, higher fatty acids, higher fatty acid mono-, di- and triglycerides, polyethoxylated monoethers of higher fatty alcohols and polyethoxylated alcohol esters of higher fatty acids, wherein the higher fatty groups are of 8 to 22 carbon atoms and the polyethoxy groups are of 3 to 50 ethoxies, and being present in a proportion of 15 to 100% by weight of the base beads, while the base beads are maintained at an elevated temperature so that the waxy material impregnates such beads about said softening agent.

11. A method according to claim 8 wherein the softening agent is mixed with a different waxy material in liquid form and the mixture is sprayed as a heated liquid onto the pre-heated base beads.

12. A method according to claim 8 wherein said softener impregnated base beads are cooled and mixed with a $C_2$–$C_8$ organic acid complexing agent and said mixture is perfumed with a perfume which includes organic alcohols and/or esters which may promote decomposition of said softening agent whereby due to the presence of the complexing acid development of an amine odor from the quaternary softening agent is inhibited.

13. A composition according to claim 1 which is coated with from ½ to 20% by weight of a particulate calcined aluminum silicate having fabric softening properties and of thin, flat and laminated plate structure with an average particle size in the range of 1 to 3 microns.

14. A composition according to claim 2 wherein the waxy material and the cationic softening agent are mixed together in the base beads.

15. A composition according to claim 2 wherein the cationic softening agent is located more centrally in the base beads than the waxy material.

16. A composition according to claim 1 wherein the base beads with cationic softening agent impregnated therein interiorly, further includes normally solid water soluble nonionic detergent mixed with or exteriorly of the cationic softener and with over 80% of the total thereof being within the exteriors of the base beads.

17. A composition according to claim 2 wherein the fabric softening agent is a di-higher alkyl dimethyl ammoinum methyl sulfate wherein the higher alkyls are of 12 to 18 carbon atoms, the waxy material is a higher fatty acid ethanolamide wherein the higher fatty acid is of 12 to 18 carbon atoms, and the proportions of such softening agent and waxy material are within the range of 1:2 to 2:1, with respect to each other and are each from 25 to 75% by weight of the base beads.

18. A composition according to claim 17 wherein the base beads comprise 30 to 60% of type 4A zeolite, 20 to 40% of sodium bicarbonate and 10 to 20% of sodium silicate of $Na_2O$:$SiO_2$ ratio in the range of 1:1.6 to 1:2.8.

19. A method according to claim 10 wherein after impregnation of the base beads with softening agent such beads are cooled to solidify the softening agent in the interiors thereof and are subsequently heated so that interior portions of the beads about the softening agent are warm enough to maintain in liquid state a liquid spray of normally solid waxy material sprayed onto the beads, such liquid waxy material at an elevated temperature is sprayed onto the beads which are at an elevated temperature and the beads are cooled so that the fabric softening composition resulting comprises base beads having internal cores of fabric softening agent surrounded by internally impregnated waxy material, and the dissolving and/or dispersing of the fabric softening agent in wash water is delayed due to the covering thereof in the individual beads by the waxy material.

20. A method according to claim 11 wherein the base beads are of particle sizes in the range of No. 40 to No.

200 U.S. Sieve sizes and comprise 30 to 60% of type 4A zeolite, 20 to 40% of sodium bicarbonate and 10 to 20% of sodium silicate of $Na_2O:SiO_2$ ratio in the range of 1:1.6 to 1:2.8, the fabric softener is a di-higher alkyl dimethyl ammonium methyl sulfate wherein the higher alkyl is of 10 to 20 carbon atoms and the waxy material is higher fatty alkyl monoethanolamide wherein the higher fatty alkyl is of 10 to 20 carbon atoms.

21. A method according to claim 8 wherein the fabric softening agent is dissolved in a solvent at an elevated temperature, which solvent maintains its liquidity at such elevated temperature and may be sprayed at such temperature, and wherein such solution of fabric softening agent in solvent at such an elevated temperature is sprayed onto the base beads.

22. A method according to claim 8 wherein the particulate fabric softening composition is impregnated with a sufficient proportion of a material selected from the group consisting of ethoxylated monoglycerides, ethoxylated diglycerides and mixtures thereof wherein the higher fatty acid(s) is/are of 8 to 22 carbon atoms, a terminal hydroxyl group of each of the glyceride(s) is ethoxylated and the number of ethoxy groups in each is in the range of 10 to 100, so as to diminish any irritating effect of the softening agent, as determined by rabbit eye testing.

23. A composition according to claim 18 coated with a flow-improving quantity of from 2 to 12% by weight, of a particulate calcined aluminum silicate having fabric softening properties and of thin, flat and laminated plate structure with an average particle size in the range of 1 to 3 microns which analyzes about 52.1% of silicon, as $SiO_2$ and about 44.4% of aluminum as $Al_2O_3$ and which loses about 0.9% of the weight thereof upon ignition.

* * * * *